US009463656B2

(12) United States Patent
Igarashi et al.

(10) Patent No.: US 9,463,656 B2
(45) Date of Patent: Oct. 11, 2016

(54) PRINTING DEVICE

(71) Applicant: FUJIFILM Corporation, Tokyo (JP)

(72) Inventors: Hiroyuki Igarashi, Kanagawa (JP); Hiroshi Uemura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/012,163

(22) Filed: Feb. 1, 2016

(65) Prior Publication Data

US 2016/0144643 A1 May 26, 2016

Related U.S. Application Data

(63) Continuation of application No. PCT/JP2014/069911, filed on Jul. 29, 2014.

(30) Foreign Application Priority Data

Aug. 2, 2013 (JP) ..... 2013-161092

(51) Int. Cl.

| | |
|---|---|
| ***B41J 29/393*** | (2006.01) |
| ***B41F 33/04*** | (2006.01) |
| ***B41K 3/04*** | (2006.01) |
| ***B41K 3/48*** | (2006.01) |
| ***B41J 11/00*** | (2006.01) |
| ***B41J 29/40*** | (2006.01) |
| ***B41J 29/46*** | (2006.01) |

(52) U.S. Cl.

CPC ..... *B41J 29/393* (2013.01); *B41F 33/04* (2013.01); *B41J 11/0095* (2013.01); *B41J 29/40* (2013.01); *B41J 29/46* (2013.01); *B41K 3/04* (2013.01); *B41K 3/48* (2013.01)

(58) Field of Classification Search

CPC .... B41J 29/393; B41J 29/46; B41J 11/0095; B41J 29/40; B41K 3/48; B41K 3/04; B41F 33/04

See application file for complete search history.

(56) References Cited

U.S. PATENT DOCUMENTS 5,448,685 A * 9/1995 Ogura ..... B41J 3/36 358/1.18
5,651,618 A * 7/1997 Tamiya ..... B41J 11/663 400/621

(Continued)

FOREIGN PATENT DOCUMENTS

JP S55-015150 A 2/1980
JP S63-068465 U 5/1988

(Continued)

OTHER PUBLICATIONS

International Search Report; PCT/JP2014/069911; Sep. 9, 2014.

(Continued)

*Primary Examiner* — Justin Seo
(74) *Attorney, Agent, or Firm* — Studebaker & Brackett PC

(57) ABSTRACT

A printing device includes an image recording portion which records an image on a sheet, an image defect detection unit which detects the sheet on which image defects occur, a setting unit by which a sorting number of copies of the sheets is set, a first stamper unit which attaches ink to a leading end edge of the sheet on which the image defects occur, and a second stamper unit which is disposed so as to be arranged with the first stamper unit in a sheet width direction and attaches ink to the leading end edge of the sheet corresponding to the sorting number of copies.

13 Claims, 8 Drawing Sheets

(56) References Cited

U.S. PATENT DOCUMENTS

| | | | | |
|---|---|---|---|---|
| 9,126,404 | B2 * | 9/2015 | Kido | B41J 2/2142 |
| 2001/0054364 | A1 * | 12/2001 | Kusaka | B41F 33/0036 101/483 |
| 2002/0048041 | A1 * | 4/2002 | Housel | B41J 11/485 358/1.15 |
| 2006/0165458 | A1 * | 7/2006 | Gortemaker | B41J 29/42 400/62 |
| 2008/0063424 | A1 * | 3/2008 | Tanaka | G03G 15/70 399/79 |
| 2009/0251716 | A1 * | 10/2009 | Igarashi | G03G 15/655 358/1.12 |
| 2009/0256304 | A1 * | 10/2009 | Koizumi | B65H 7/18 271/10.09 |
| 2011/0050790 | A1 | 3/2011 | Irita | |
| 2012/0099913 | A1 * | 4/2012 | Joseph | B41J 11/0075 400/582 |
| 2012/0250104 | A1 * | 10/2012 | Watanabe | H04N 1/32 358/448 |
| 2015/0336381 | A1 * | 11/2015 | Kyoso | B41J 2/0451 347/14 |

FOREIGN PATENT DOCUMENTS

| | | | |
|---|---|---|---|
| JP | H04-020456 | A | 1/1992 |
| JP | H07-021339 | Y2 | 5/1995 |
| JP | H09-240120 | A | 9/1997 |
| JP | 2004-191631 | A | 7/2004 |
| JP | 2007-302348 | A | 11/2007 |
| JP | 2011-046872 | A | 3/2011 |
| JP | 2011-177991 | A | 9/2011 |
| JP | 2012-121238 | A | 6/2012 |

OTHER PUBLICATIONS

International Preliminary Report on Patentability; PCT/JP2014/069911; Feb. 10, 2015.

* cited by examiner

PRINTING DEVICE

CROSS-REFERENCE TO RELATED APPLICATIONS

The present application is a Continuation of PCT International Application No. PCT/JP2014/069911 filed on Jul. 29, 2014 claiming priority under 35 U.S.C §119(a) to Japanese Patent Application No. 2013-161092 filed on Aug. 2, 2013. Each of the above applications is hereby expressly incorporated by reference, in their entirety, into the present application.

BACKGROUND OF THE INVENTION

1. Field of the Invention

The present invention relates to a printing device, and particularly, to a technology for automating a function which specifies a defective recording medium from recording media loaded on a sheet discharging portion or specifies classification division for each unit of the number of copies.

2. Description of the Related Art

An ink jet recording device is a device which forms an image by continuously hitting ink onto a recording medium, and since a device configuration is simple and image recording having improved image quality can be performed, the ink jet recording device is widely used in not only a home printer for individual use but also an office printer or a printing device for business use.

In the ink jet recording device, for example an image is recorded on a surface of a recording medium using aqueous ink by an ink-jet system while conveying a recording medium sheet (JP2011-46872A, or the like).

In the ink jet recording device for business use, processing at a high speed and high image quality are required, and it is necessary to specify a defective recording medium from recording media in which images are recorded and which are loaded on a sheet discharging portion, or to specify classification division for each unit of the number of copies.

That is, in the recording media which are recorded by the image recording portion of the ink jet recording device, it is not considered that the images of all the recording media are necessarily in satisfied recording states, and image defects may exist on some recording media. In addition, stains exist on the recording medium, and a defective medium may occur.

In the related art, a configuration is suggested, in which a buzzer sounds when defects are detected by a sensor or the like of the ink jet recording device in a case where the defective medium occurs. In the configuration, the defective medium of the recording media loaded on a discharging portion is specified by manually attaching a tag to the defective recording medium, and the recording medium to which the tag is attached is manually pushed out after a print job ends.

In addition, for example, when management of a sorting number of copies is performed every 100 sheets, in the recording media loaded on the sheet discharging portion, a tag or a tape is manually inserted every hundredth sheet so as to specify classification division.

As means for automating the specification operation of the defective medium or the specification operation of the classification division which is manually performed, it is suggested that a tape inserter is provided in the ink jet recording device as an option. This is a method, in which in recording media loaded on the sheet discharging portion, a tape is automatically inserted into a position of a defective recording medium or a position of a recording medium corresponding to the classification division.

For example, JP2007-302348A discloses a sheet printing machine which includes a tape inserter on a side of a sheet discharging table. According to JP2007-302348A, when the tape inserter is operated, an end portion of a tape discharged from a tape reel by a tape feed mechanism is inserted into a portion between a sheet loaded on the sheet discharging table and a chain delivery, and the inserted portion is cut from the tape reel by a cutter which is incorporated into a feed mechanism. That is, the tape insertion is performed by three steps such as a step of discharging the tape from the tape reel, a step of inserting the tape into a portion between recording media, and a step of cutting the inserted tape.

SUMMARY OF THE INVENTION

However, since the tape inserter uses a method in which the above-described three steps are required and a method in which a tape is inserted into a portion between recording media using weight of the loaded recording media, there are the following problems.

(1) When defective recording media continuously occur, the tape is required to be continuously inserted into a portion between recording media at a speed corresponding to a loading speed of the recording media. Accordingly, in a high speed ink jet recording device such as for business use, an insertion speed of the tape cannot keep up with the loading speed of the recording medium, and there is a problem that all image-defective recording media cannot be specified (problems accompanied by high speed).

(2) When a tape is inserted into a portion between recording media immediately before a print job ends in order to specify classification division by managing the sorting number of copies, there is a problem that the tape serving as a mark falls out due to insufficient weight of the recording media placed on the tape. Accordingly, the recording media into which the tape is inserted are not recognized, and there is a problem that management is not performed (mark falling-out problem).

(3) Since the tape inserter inserts the tape into the portion between the recording media loaded on the sheet discharging portion, there is a problem that the tape inserter is disposed at only the position of the sheet discharging portion. Accordingly, not only does a degree of freedom of design of the ink jet recording device decrease, but there is also a problem that a size of the ink jet recording device increases if the tape inserter is disposed at the position of the sheet discharging portion. Accordingly, when the tape inserter is used, a device which is separately provided to the ink jet recording device is required (problem in degree of freedom of disposition).

(4) If air (for example, conditioned air or drying air generated in the ink jet recording device) flows when the tape is inserted by the tape inserter, there is a problem that the tape cannot be correctly inserted (problem in disposition environment).

Accordingly, in the tape inserter which is the device for automating the specification operation of the defective medium or the specification operation of the classification division which is manually performed, there are various problems such as the problem accompanied by high speed, the mark falling-out problem, the problem in a degree of freedom of disposition, or the problem in a disposition environment, and it is preferable to develop an ink jet recording device which solves the above-described problems.

The present invention is made in consideration of the above-described circumstances, and an object thereof is to provide a printing device capable of solving the problem accompanied by high speed, the mark falling-out problem, the problem in a degree of freedom of disposition, and the problem in a disposition environment of the related art, when automation is performed for the specification operation of the defective medium or the specification of the classification division.

Means for solving the problems is as follows.

[1] According to a first aspect, there is provided a printing device, including: a conveyance portion which conveys a recording medium sheet from a sheet feed portion to a sheet discharging portion; an image recording portion which records an image on a surface of the conveyed recording medium; an image defect detection unit which detects a recording medium, on which image defects occur, among the recording media which is conveyed and recorded; a first stamper unit which is provided on a downstream side of the image recording portion in the conveyance portion and attaches ink to a leading end edge of the recording medium on which the image defects occur; a first stamp control unit which controls an operation of the first stamper unit based on detection results of the image defect detection unit; a setting unit which sets a sorting number of copies every predetermined number of sheets of the recording media which are recorded by the image recording portion; a second stamper unit which is provided on the downstream side of the image recording portion in the conveyance portion and attaches ink to the leading end edge of the recording medium corresponding to the set sorting number of copies; and a second stamp control unit which controls an operation of the second stamper unit based on the set sorting number of copies.

According to the present aspect, when the defective recording medium is detected by the image defect detection unit, the first stamp control unit operates the first stamper unit, and the first stamper unit attaches ink to the leading end edge of the recording medium which is conveyed by the conveyance portion and in which image defects occur. Accordingly, it is possible to simply specify the defective recording medium visually among the recording media loaded on the sheet discharging portion.

In addition, based on the preset sorting number of copies (for example, a unit of 100 sheets), when a recording medium (for example, 100th recording medium) corresponding to the sorting number of copies is conveyed to the position of the second stamper unit, the second stamp control unit attaches ink to a leading end edge of the recording medium. The attachment of ink with respect to the recording medium corresponding to the sorting number of copies is repeated. Accordingly, it is possible to simply specify a bundle for each sorting number of copies visually among the recording media loaded on the sheet discharging portion.

Accordingly, it is possible to incorporate automation with respect to a specification operation of a defective medium and management of the sorting number of copies into an ink jet recording device, and compared to a tape inserter, the printing device includes the following advantages due to characteristics of the stamper device.

Since the first and second stamper units simply attach ink to the leading end edge of the conveyed recording medium, a speed from starting of an operation to ending of an operation is high, and for example, the first and second stamper units can cope with a high speed ink jet recording device such as an ink jet recording device for business use.

Since the first and second stamper units use the method which attaches ink to the recording medium, when the recording media are loaded on the sheet discharging portion, the ink serving as a mark does not fall out. In addition, since the ink is separately attached to each recording medium, even when image defects continuously occur, it is possible to separately and continuously attach ink to the recording medium.

Unlike the tape inserter, the first and second stamper units are not limited to the case where the stamper units are disposed in the sheet discharging portion. As long as the first and second stamper units are disposed on the downstream side of the image recording portion in the medium conveyance direction of the conveyance portion, the first and second stamper units can be disposed at any position. Accordingly, it is possible to increase a degree of freedom of design with respect to dispositions of members of the ink jet recording device.

Since the first and second stamper units use the method which attaches ink to the recording medium, even when air flows around the stamper device, there is no problem.

Therefore, according to the first and second stamper units, it is possible to solve the problem accompanied by high speed, the mark falling-out problem, the problem in a degree of freedom of disposition, and the problem in a disposition environment which occur when the tape inserter is used.

[2] According to a second aspect, in the first aspect, stamp performance positions, at which a stamp which attaches ink to the recording medium using the first stamper unit and the second stamper unit is performed, are the same as each other in a conveyance direction of the conveyance portion, and distances of the first stamper unit and the second stamper unit from positions corresponding to a center position of the recording medium in a direction orthogonal to the conveyance direction of the conveyance portion are different from each other.

Accordingly, when duplex printing is performed, a marking position on a surface and a marking position on a rear surface do not overlap each other, and discrimination is easily performed.

[3] According to a third aspect, in the first or second aspect, a kind of the ink used in the first stamper unit and a kind of the ink used in the second stamper unit are different from each other.

Accordingly, it is possible to easily distinguish whether the ink attached to the leading end edge of the recording medium is the ink for the specification operation of the defective medium or the ink for the management of the sorting number of copies.

The kind of the ink includes a color of ink. By using the ink having different colors, it is possible to more easily discriminate the kind of the stamp.

The different ink colors include shades of the color being different from each other in the same color. For example, there may be an aspect in which ink having a normal density is used for the first stamper unit and a light ink (ink which has lower density than the normal density) is used for the second stamper unit.

[4] According a fourth aspect, in any one of the first to third aspects, the ink which is used in the first stamper unit and the second stamper unit is formed of a highly water retentive material. Particularly, since the first stamper unit for performing the specification operation of the defective medium is driven less, the ink is easily dried. However, since the ink is formed of the highly water retentive material, it is possible to reliably prevent the ink from drying.

[5] According to a fifth aspect, in any one of the first to fourth aspects, each of the first stamper unit and the second stamper unit includes a stamp portion into which ink is impregnated, and a retractable mechanism which causes the stamp portion to protrude toward a stamp position of the recording medium or retracts the stamp portion from the stamp position, and in a state where the stamp portion protrudes toward the stamp position, the lead end edge of the recording medium conveyed by the conveyance portion abuts the stamp portion and ink is attached to the leading end edge, and the stamp portion is retracted from the stamp position by the force of the abutment.

Accordingly, if the leading end edge of the recording medium abuts the stamp portion when the recording medium passes through the stamp portion and ink is attached to the leading end edge, even when the speed of the ink jet recording device increases, that is, even when the conveyance of the recording medium performed by the conveyance portion is rapid, it is possible to reliably attach the ink to the leading end edge of the recording medium.

In addition, the retractable mechanism which causes the stamp portion to protrude toward a stamp position or retracts the stamp portion from the stamp position is provided, and the stamp portion is retracted by the force by which the leading end edge of the recording medium abuts the stamp portion. Accordingly, since the stamp portion is exposed to only the recording medium to which the ink is attached, there is no interference with the conveyance of the recording medium in which the ink attachment is not required.

[6] According to a sixth aspect, in the fifth aspect, the stamp portion is accommodated in a stamp container, and an opening/closing lid, which opens and closes the stamp container so as to be interlocked with the retractable mechanism and exposes and seals the stamp portion, is provided in the stamp container.

Accordingly, it is possible to further prevent the ink which is impregnated into the stamp portion from drying.

[7] According to a seventh aspect, in the fifth or sixth aspect, the first stamper unit includes a stamp movement portion which moves the stamp portion between a standby position and the stamp position, and a position detection unit which detects whether the stamp portion is positioned at the standby position or the stamp position, and the conveyance portion stops conveyance of the recording medium when it is not detected that the stamp portion is positioned at the stamp position by the position detection unit after a predetermined period elapses from a timing when the stamp movement portion starts a movement which moves the stamp portion from the standby position to the stamp position.

When the stamp portion does not move with respect to the operation of the stamp movement portion, since the conveyance of the recording medium stops, it is possible to avoid non-stamping due to abnormality (failure) of the first stamper unit.

[8] According to an eighth aspect, in the seventh aspect, the conveyance portion stops the conveyance of the recording medium when it is not detected that the stamp portion is positioned at the standby position by the position detection unit in at least one of at the time of device operation start and at the time of print job change.

It is possible to detect abnormality of the first stamper unit in at least one of at the time of the device operation start and at the time of the print job change.

[9] According to a ninth aspect, in any one of the first to eighth aspects, the conveyance portion includes a chain gripper, in which a plurality of grippers holding a leading end portion of the recording medium between a pair of chains are provided at a position on the downstream side of the image recording portion in the conveyance direction of the conveyance portion, and on the upstream side of a sheet discharging portion, which discharges the recording medium having images formed by the image recording portion, in the conveyance direction of the conveyance portion, and the first stamper unit and the second stamper unit are provided inside the disposition position of the chain gripper.

Since the chain gripper is conveying means for holding both sides of the leading end portion of the recording medium by the grippers provided on a pair of parallel endless chains, if the first stamper unit and the second stamper unit are disposed between the pair of chains, compactification of the ink jet recording device is improved.

Here, the "stamper units being provided inside the disposition position" includes a case where the stamper units are disposed in a concave portion which is provided on a support surface (a surface by which a portion except for the leading end portion is supported) of the recording medium conveyed by the pair of chains.

[10] According to a tenth aspect, in the ninth aspect, the chain gripper is disposed along an inclined surface which has an upward inclination with respect to a horizontal surface, and the first stamper unit and the second stamper unit are disposed in a concave portion which is formed on the inclined surface.

Since the first stamper unit and the second stamper unit are disposed in the concave portion which is formed on the inclined surface having an upward inclination, it is possible to decrease a size of the device.

[11] According to an eleventh aspect, in any one of the first to tenth aspects, the first stamper unit and the second stamper unit have the same configuration as each other.

Since the first stamper unit and the second stamper unit have the same configuration as each other, it is possible to achieve a common use of a device, improvement in ease of maintenance, and reduction of a device cost and a maintenance cost.

[12] According to a twelfth aspect, in any one of the first to eleventh aspects, the second stamp control unit operates the second stamper unit when the number of recording media except for the detected recording media having image defects reaches the set sorting number of copies. Accordingly, it is possible to prevent a risk of defective recording media being included within the sorting number of copies.

According to the ink jet recording device of the present invention, when the specification operation of the defective medium or the management of the sorting number of copies is automated, it is possible to solve the problem accompanied by high speed, the falling-out problem, the problem in the degree of freedom of disposition, and the problem in the disposition environment of the related art.

DESCRIPTION OF THE PREFERRED EMBODIMENTS

Hereinafter, an embodiment of an ink jet recording device (printing device) of the present invention will be described in detail with reference to accompanying drawings. In addition, in the present embodiment, an example is described in which a flocculation treatment liquid is used and aqueous UV ink is used. However, the present invention can be also applied to when the flocculation treatment liquid is not used or when oil-based ink is used.

<<Device Configuration>>

Figure 1:
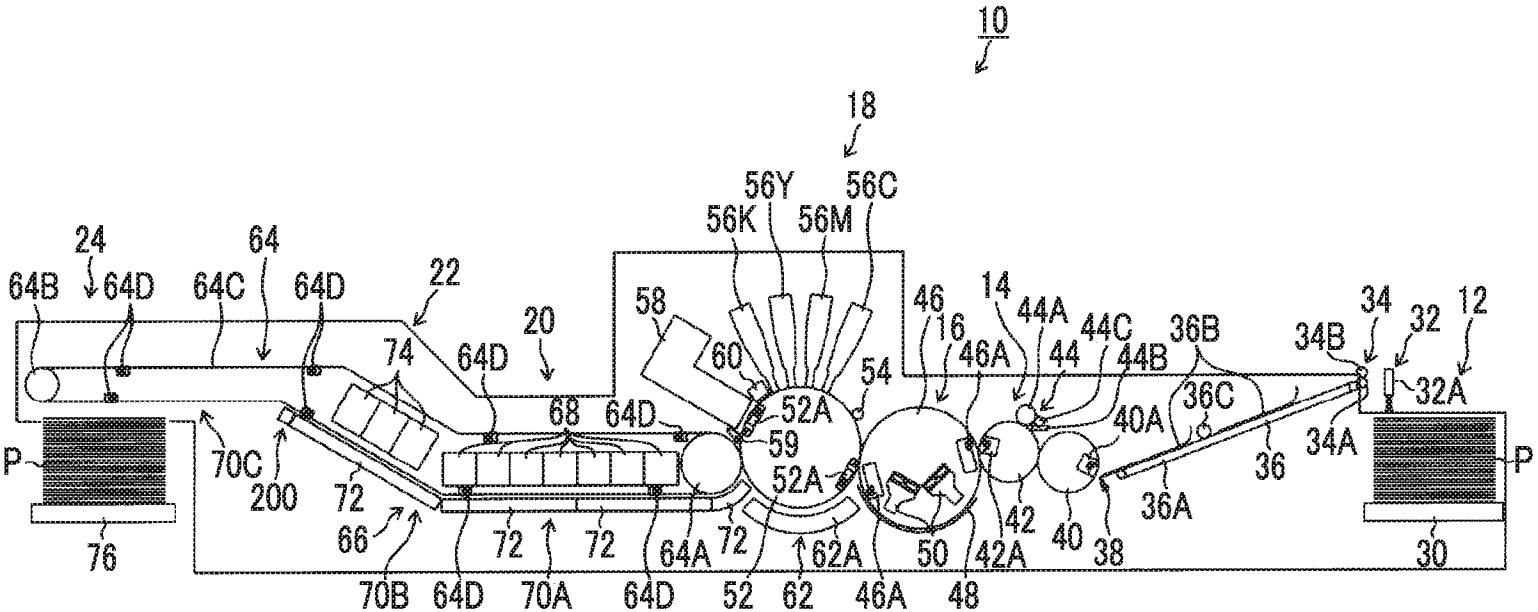
FIG. 1 is an overall configuration view showing an embodiment of an ink jet recording device according to the present invention.

FIG. 1 is an overall configuration view showing an embodiment of an ink jet recording device according to the present invention.

An ink jet recording device 10 is an ink jet recording apparatus in which an image is recorded on a paper sheet (recording medium) P according to an ink-jet system using aqueous UV ink (ultraviolet (UV) curable ink using an aqueous medium). The ink jet recording device 10 mainly includes a sheet feed portion 12 which feeds the sheet P, a treatment liquid application portion 14 which applies a predetermined treatment liquid to the surface (image recording surface) of the sheet P which is fed from the sheet feed portion 12, a treatment liquid drying processing portion 16 which performs drying processing on the sheet P to which the treatment liquid is applied by the treatment liquid application portion 14, an image recording portion 18 which records an image on the surface of the sheet P to which the drying processing is applied by the treatment liquid drying processing portion 16 according to an ink-jet system using the aqueous UV ink, an ink drying processing portion 20 which performs drying processing on the sheet P on which the image is recorded by the image recording portion 18, a UV irradiation processing portion 22 which performs UV irradiation processing (fixing process) on the sheet P to which the drying processing is applied by the ink drying processing portion 20 so as to fix the image, a stamper processing unit 200 which fixes ink to the sheet P, and a sheet discharging portion 24 on which the sheets P, which are subjected to all processing and are discharged, are loaded. In addition, conveyance of the sheet P from the sheet feed portion 12 to the sheet discharging portion 24 is performed by a conveyance portion which includes drum type conveyance means and chain gripper type conveyance means described below.

<Sheet Feed Portion>

The sheet feed portion 12 feeds the sheets P loaded on the sheet feed rack 30 to the treatment liquid application portion 14 one by one. The sheet feed portion 12 mainly includes a sheet feed rack 30, a sucker device 32, a pair of sheet feed rollers 34, a feeder board 36, a front abutment 38, and a sheet feed drum 40.

The sheets P are placed on the sheet feed rack 30 in a bundle state in which the plurality of sheets P are laminated. The sheet feed rack 30 can be lifted and lowered by a sheet feed rack lifting device (not shown). Driving of the sheet feed rack lifting device is controlled so as to be interlocked with an increase or a decrease of the sheets P loaded on the sheet feed rack 30, and the sheet feed rack lifting device lifts and lowers the sheet feed rack 30 such that the sheet P positioned at the uppermost position of the bundle is always positioned at a constant height.

The sheet P serving as the recording medium is not particularly limited. However, a general-purpose printing sheet (a sheet which has cellulose as a main constituent such as wood free paper, coat paper, or art paper) which is used in general off-set printing or the like may be used. In the present example, coated paper is used. In general, in the coated paper, a coating material is coated on a surface of wood free paper, neutral paper, or the like, in which surface processing is not performed, so as to provide a coating layer. Specifically, art paper, coat paper, light coat paper, fine coating paper, or the like is suitably used.

The sucker device 32 sequentially picks up the sheets P loaded on the sheet feed rack 30 one by one from above, and feeds the sheet P to the pair of sheet feed rollers 34. The sucker device 32 includes a suction foot 32A which is liftably and swingably provided, the upper surface of the sheet P is adsorbed and held by the suction foot 32A, and the sheet P is fed from the sheet feed rack 30 to the pair of sheet feed rollers 34. In this case, the suction foot 32A adsorbs and holds an upper surface of a leading end side of the sheet P positioned at the uppermost position of the bundle, lifts the sheet P, and inserts the leading end of the lifted sheet P into a portion between a pair of rollers 34A and 34B configuring the pair of sheet feed rollers 34.

The pair of sheet feed rollers 34 is configured of the pair of upper and lower rollers 34A and 34B which are pressed and abutted to each other. In the pair of upper and lower rollers 34A and 34B, one is a driving roller (roller 34A), the other is a driven roller (roller 34B), and the driving roller (roller 34A) is driven and rotated by a motor (not shown). The motor is driven so as to be interlocked with feeding of the sheet P, and if the sheet P is fed from the sucker device 32, the driving roller (roller 34A) is rotated by the motor in accordance with the timing of the feeding. The sheet P which is inserted into the portion between the pair of upper and lower rollers 34A and 34B is nipped to the rollers 34A and 34B, and is discharged in rotation directions of the rollers 34A and 34B (an installation direction of the feeder board 36).

The feeder board 36 is formed so as to correspond to a width of the sheet, receives the sheet P discharged from the pair of sheet feed rollers 34, and guides the sheet P to the front abutment 38. The feeder board 36 is installed such that the tip side is inclined downward, causes the sheet P placed on the conveyance surface to slide along the conveyance surface, and guides the sheet P to the front abutment 38.

A plurality of tape feeders 36A for conveying the sheet P are installed in the feeder board 36 with intervals in a width direction. The tape feeder 36A is formed in an endless shape and is rotated by a motor (not shown). The sheet P which is placed on the conveyance surface of the feeder board 36 is sent by the tape feeder 36A and is conveyed to the feeder board 36.

In addition, a retainer 36B and a roller 36C are installed on the feeder board 36.

The plurality of retainers 36B are disposed so as to be arranged on front and rear sides along the conveyance surface of the sheet P (two retainers in the present example). The retainer 36B is configured of a plate spring having a width corresponding to the width of the sheet, and is installed so as to be pressed and abutted to the conveyance surface. The sheet P, which is conveyed onto the feeder board 36 by the tape feeder 36A, passes through the retainers 36B, and unevenness of the sheet P is corrected. In addition, the rear end portion of the retainer 36B is formed so as to be curled in order to easily introduce the sheet P into a portion between the retainer 36B and the feeder board 36.

The roller 36C is disposed between the front and rear retainers 36B. The roller 36C is installed so as to be pressed and abutted to the conveyed surface of the sheet P. The sheet P which is conveyed between the front and rear retainers 36B is conveyed in a state where the upper surface of the sheet P is pressed by the roller 36C.

The front abutment 38 corrects a posture of the sheet P. The front abutment 38 is formed in a plate shape and is disposed so as to be orthogonal to the conveyance direction of the sheet P. In addition, the front abutment 38 is driven by a motor (not shown) and is swingably provided. The leading end of the sheet P which is conveyed onto the feeder board 36 abuts the front abutment 38, and the posture of the sheet P is corrected (so-called skew prevention). The front abutment 38 is swung so as to be interlocked with the feeding of the sheet to the sheet feed drum 40, and the sheet P in which the posture is corrected is transferred to the sheet feed drum 40.

The sheet feed drum 40 receives the sheet P which is fed from the feeder board 36 via the front abutment 38, and conveys the sheet P to the treatment liquid application portion 14. The sheet feed drum 40 is formed in a cylindrical shape, and is driven and rotated by a motor (not shown). A gripper 40A is provided on the outer circumferential surface of the sheet feed drum 40, and the leading end of the sheet P is held by the gripper 40A. The sheet feed drum 40 rotates while holding the leading end of the sheet P by the gripper 40A. Accordingly, the sheet P is wound around the circumferential surface of the sheet feed drum 40 and is conveyed to the treatment liquid application portion 14.

The sheet feed portion 12 is configured as described above. According to this configuration, the sheets P loaded on the sheet feed rack 30 are sequentially pulled up one by one from above by the sucker device 32, and are fed to the pair of sheet feed rollers 34. The sheet P which is fed to the pair of sheet feed rollers 34 is discharged forward by the pair of upper and lower rollers 34A and 34B configuring the pair of sheet feed rollers 34, and is placed on the feeder board 36. The sheet P placed on the feeder board 36 is conveyed by the tape feeder 36A which is provided on the conveyance surface of the feeder board 36. In addition, the sheet P is pressed to the conveyance surface of the feeder board 36 by the retainer 36B during the conveyance process, and unevenness of the sheet P is corrected. The leading end of the sheet P which is conveyed by the feeder board 36 abuts the front abutment 38, the inclination of the sheet P is corrected, and thereafter, the sheet P is transferred to the sheet feed drum 40. Moreover, the sheet P is conveyed to the treatment liquid application portion 14 by the sheet feed drum 40.

<Treatment Liquid Application Portion>

The treatment liquid application portion 14 applies a predetermined treatment liquid to the surface (image recording surface) of the sheet P. The treatment liquid application portion 14 mainly includes a treatment liquid application drum 42 which conveys the sheet P, and a treatment liquid application unit 44 which applies the predetermined treatment liquid to the printing surface of the sheet P which is conveyed by the treatment liquid application drum 42.

The treatment liquid application drum 42 receives the sheet P from the sheet feed drum 40 of the sheet feed portion 12, and conveys the sheet P to the treatment liquid drying processing portion 16. The treatment liquid application drum 42 is formed in a cylindrical shape, and is driven and rotated by a motor (not shown). A gripper 42A is provided on the outer circumferential surface of the treatment liquid application drum 42, and the leading end of the sheet P is held by the gripper 42A. The treatment liquid application drum 42 rotates while holding the leading end of the sheet P by the gripper 42A. Accordingly, the sheet P is wound around the circumferential surface of the treatment liquid application drum 42 and is conveyed to the treatment liquid drying processing portion 16 (one sheet P is conveyed by one rotation). The rotations of the treatment liquid application drum 42 and the sheet feed drum 40 are controlled such that timings of receiving and transferring the sheet P are matched to each other. That is, the treatment liquid application drum 42 and the sheet feed drum 40 are driven so as to be the same circumferential speed and are driven so that the positions of the grippers are matched to each other.

The treatment liquid application unit 44 roll-coats the surface of the sheet P, which is conveyed by the treatment liquid application drum 42, with the treatment liquid. The treatment liquid application unit 44 mainly includes a coating roller 44A which coats the sheet P with the treatment liquid, a treatment liquid tank 44B in which the treatment liquid is stored, and a draw-up roller 44C which draws up the treatment liquid stored in the treatment liquid tank 44B and supplies the treatment liquid to the coating roller 44A. The draw-up roller 44C is installed so as to be pressed and abutted to the coating roller 44A, and is installed such that a portion of the draw-up roller 44C is immersed into the treatment liquid stored in the treatment liquid tank 44B. The draw-up roller 44C measures and draws up the treatment liquid, and the draw-up roller 44C applies the treatment liquid to the circumferential surface of the coating roller 44A at a constant thickness. The coating roller 44A is provided so as to correspond to the width of the sheet, is pressed and abutted to the sheet P, and coats the sheet P with the treatment liquid applied to the circumferential surface of the coating roller 44A. The coating roller 44A is driven by an abutment separation mechanism (not shown), and moves between an abutment position which abuts the circumferential surface of the treatment liquid application drum 42 and a separation position which is separated from the circumferential surface of the treatment liquid application drum 42. The abutment separation mechanism moves the coating roller 44A in accordance with a passing-through timing of the sheet P, and coats the surface of the sheet P conveyed by the treatment liquid application drum 42 with the treatment liquid.

In addition, in the present example, the treatment liquid is roll-coated. However, the method of applying the treatment liquid is not limited to this. For example, a configuration which applies the treatment liquid using an ink-jet head or a configuration which applies the treatment liquid by spraying may be adopted.

The treatment liquid application portion 14 is configured as described above. According to this configuration, the sheet P which is transferred from the sheet feed drum 40 of the sheet feed portion 12 is received by the treatment liquid application drum 42. The treatment liquid application drum 42 holds the leading end of the sheet P by the gripper 42A and rotates. Accordingly, the sheet P is wound around the circumferential surface of the treatment liquid application drum 42 and is conveyed. In the conveyance process, the coating roller 44A is pressed and abutted to the surface of the sheet P, and the treatment liquid is coated on the surface of the sheet P.

Here, as the treatment liquid which is coated on the surface of the sheet P, a treatment liquid is coated, which has a function which flocculates a coloring material contained in aqueous UV ink hit to the sheet P by the image recording portion 18 provided at the rear stage of the treatment liquid application portion 14. Since the surface of the sheet P is coated with the treatment liquid and the aqueous UV ink is hit to the surface of the sheet P, even when a general-purpose printing sheet is used, it is possible to perform high-quality printing without generating landing interference or the like.

<Treatment Liquid Drying Processing Portion>

The treatment liquid drying processing portion 16 performs drying processing on the sheet P in which the treatment liquid is applied to the surface. The treatment liquid drying processing portion 16 mainly includes a treatment liquid drying processing drum 46 which conveys the sheet P, a sheet conveyance guide 48, and a treatment liquid drying processing unit 50 which blows hot air to the printing surface of the sheet P conveyed by the treatment liquid drying processing drum 46 so as to dry the sheet P.

The treatment liquid drying processing drum 46 receives the sheet P from the treatment liquid application drum 42 of the treatment liquid application portion 14, and conveys the sheet P to the image recording portion 18. The treatment liquid drying processing drum 46 is configured of a cylindrical frame body, and is driven and rotated by a motor (not shown). A gripper 46A is provided on the outer circumferential surface of the treatment liquid drying processing drum 46, and the leading end of the sheet P is held by the gripper 46A. The treatment liquid drying processing drum 46 rotates while holding the leading end of the sheet P by the gripper 46A. Accordingly, the sheet P is conveyed to the image recording portion 18.

In addition, in the present example, the grippers 42A are disposed at two locations on the outer circumferential surface of the treatment liquid drying processing drum 46, and two sheets P can be conveyed by one rotation. The rotations of the treatment liquid drying processing drum 46 and the treatment liquid application drum 42 are controlled such that timings of receiving and transferring the sheet P are matched to each other. That is, the treatment liquid drying processing drum 46 and the treatment liquid application drum 42 are driven so as to be the same circumferential speed and are driven so that the positions of the grippers 42A are matched to each other.

The sheet conveyance guide 48 is disposed along the conveyance route of the sheet P of the treatment liquid drying processing drum 46 and guides the conveyance of the sheet P.

The treatment liquid drying processing unit 50 is installed inside the treatment liquid drying processing drum 46, and blows hot air toward the surface of the sheet P conveyed by the treatment liquid drying processing drum 46 so as to dry the surface of the sheet P. In the present example, two treatment liquid drying processing units 50 are inside the treatment liquid drying processing unit, and blow hot air toward the surface of the sheet P which is conveyed by the treatment liquid drying processing drum 46.

The treatment liquid drying processing portion 16 is configured as described above. According to this configuration, the sheet P, which is transferred from the treatment liquid application drum 42 of the treatment liquid application portion 14, is received by the treatment liquid drying processing drum 46. The treatment liquid drying processing drum 46 holds the leading end of the sheet P by the gripper 46A, and conveys the sheet P through the rotation. In this case, the surface (the surface which is coated with the treatment liquid) of the sheet P is conveyed toward the inner side of the treatment liquid drying processing drum 46. In the process in which the sheet P is conveyed by the treatment liquid drying processing drum 46, hot air from the treatment liquid drying processing unit 50 installed inside the treatment liquid drying processing drum 46 is blown to the surface of the sheet P, and the surface of the sheet P is dried. That is, a solvent component contained in the treatment liquid is removed. Accordingly, an ink flocculation layer is formed on the surface of the sheet P.

<Image Recording Portion>

The image recording portion 18 hits droplets of ink (aqueous UV ink) of each of C (cyan), M (magenta), Y (yellow), and K (black) to the printing surface of the sheet P so as to draw a color image on the printing surface of the sheet P. The image recording portion 18 mainly includes an image recording drum 52 which conveys the sheet P, a sheet pressing roller 54 which presses the sheet P conveyed by the image recording drum 52 and allows the sheet P to come into contact with the circumferential surface of the image recording drum 52, ink-jet heads 56C, 56M, 56Y, and 56K which eject ink droplets of each of C, M, Y, and K onto the sheet P, an inline sensor 58 which reads an image recorded on the sheet P, a mist filter 60 which captures ink mist, and a drum cooling unit 62.

The image recording drum 52 receives the sheet P from the treatment liquid drying processing drum 46 of the treatment liquid drying processing portion 16, and conveys the sheet P to the ink drying processing portion 20. The image recording drum 52 is formed in a cylindrical shape and is driven and rotated by a motor (not shown). A gripper 52A is provided on the outer circumferential surface of the image recording drum 52, and holds the leading end of the sheet P by the gripper 52A. The image recording drum 52 rotates while holding the leading end of the sheet P by the gripper 52A. Accordingly, the sheet P is wound around the circumferential surface of the image recording drum 52 and is conveyed to the ink drying processing portion 20. In addition, a plurality of suction holes (not shown) are formed on the circumferential surface of the image recording drum 52 in a predetermined pattern. The sheet P wound around the circumferential surface of the image recording drum 52 is sucked from the suction holes, and the sheet P is conveyed while being adsorbed and held to the circumferential surface of the image recording drum 52. Accordingly, it is possible to convey the sheet P with high flatness.

In addition, the suction of the suction holes is operated only within a predetermined range, and is operated between a predetermined suction start position and a predetermined suction ending position. The suction start position is set at an installation position of the sheet pressing roller 54, and the suction ending position is set on the downstream side of an installation position of the inline sensor 58 (for example, set at a position at which the sheet is transferred to the ink drying processing portion 20). In addition, the suction start position and the suction ending position are set such that the sheet P is adsorbed and held to the circumferential surface of the image recording drum 52 in at least the installation positions (image recording position) of the ink-jet heads 56C, 56M, 56Y, and 56K and the installation position (image reading position) of the inline sensor 58.

In addition, a mechanism which adsorbs and holds the sheet P to the circumferential surface of the image recording drum 52 is not limited to the adsorption method using the above-described negative pressure. That is, a method using electrostatic adsorption may be adopted.

In addition, in the present example, the grippers 52A are disposed at two locations on the outer circumferential surface of the image recording drum 52, and two sheets P can be conveyed by one rotation. The rotations of the image recording drum 52 and the treatment liquid drying processing drum 46 are controlled such that timings of receiving and transferring the sheet P are matched to each other. That is, the image recording drum 52 and the treatment liquid drying processing drum 46 are driven so as to be the same circumferential speed and are driven so that the positions of the grippers are matched to each other.

The sheet pressing roller 54 is disposed in the vicinity of the position (the position at which the image recording drum 52 receives the sheet P from the treatment liquid drying processing drum 46) at which the image recording drum 52 receives the sheet. The sheet pressing roller 54 is configured of a rubber roller, and is installed so as to be pressed and abutted to the circumferential surface of the image recording drum 52. The sheet P, which is transferred from the treatment liquid drying processing drum 46 to the image recording drum 52, passes through the sheet pressing roller 54 so as to be nipped, and the sheet P comes into close contact with the circumferential surface of the image recording drum 52.

The four ink-jet heads 56C, 56M, 56Y, and 56K are disposed with predetermined intervals along the conveyance route of the sheet P of the image recording drum 52. The ink-jet heads 56C, 56M, 56Y, and 56K are configured of a line head corresponding to the width of the sheet, and a nozzle surface of each head is disposed so as to face the circumferential surface of the image recording drum 52. Each of the ink-jet heads 56C, 56M, 56Y, and 56K ejects droplets of the ink onto the image recording drum 52 from a nozzle row formed on the nozzle surface, and an image is recorded on the sheet P which is conveyed by the image recording drum 52.

In addition, as described above, the ink which is ejected from the ink-jet heads 56C, 56M, 56Y, and 56K uses aqueous UV ink. After the aqueous UV ink hits the sheet, the aqueous UV ink is irradiated with ultraviolet (UV) so as to be cured.

The inline sensor 58 is disposed on the downstream side of the rearmost ink-jet head 56K in the conveyance direction of the sheet P of the image recording drum 52, and reads the image which is recorded by the ink-jet heads 56C, 56M, 56Y, and 56K. For example, the inline sensor 58 is configured of a line scanner, and reads the image, which is recorded by the ink-jet heads 56C, 56M, 56Y, and 56K, from the sheet P conveyed by the image recording drum 52.

Figure 4:
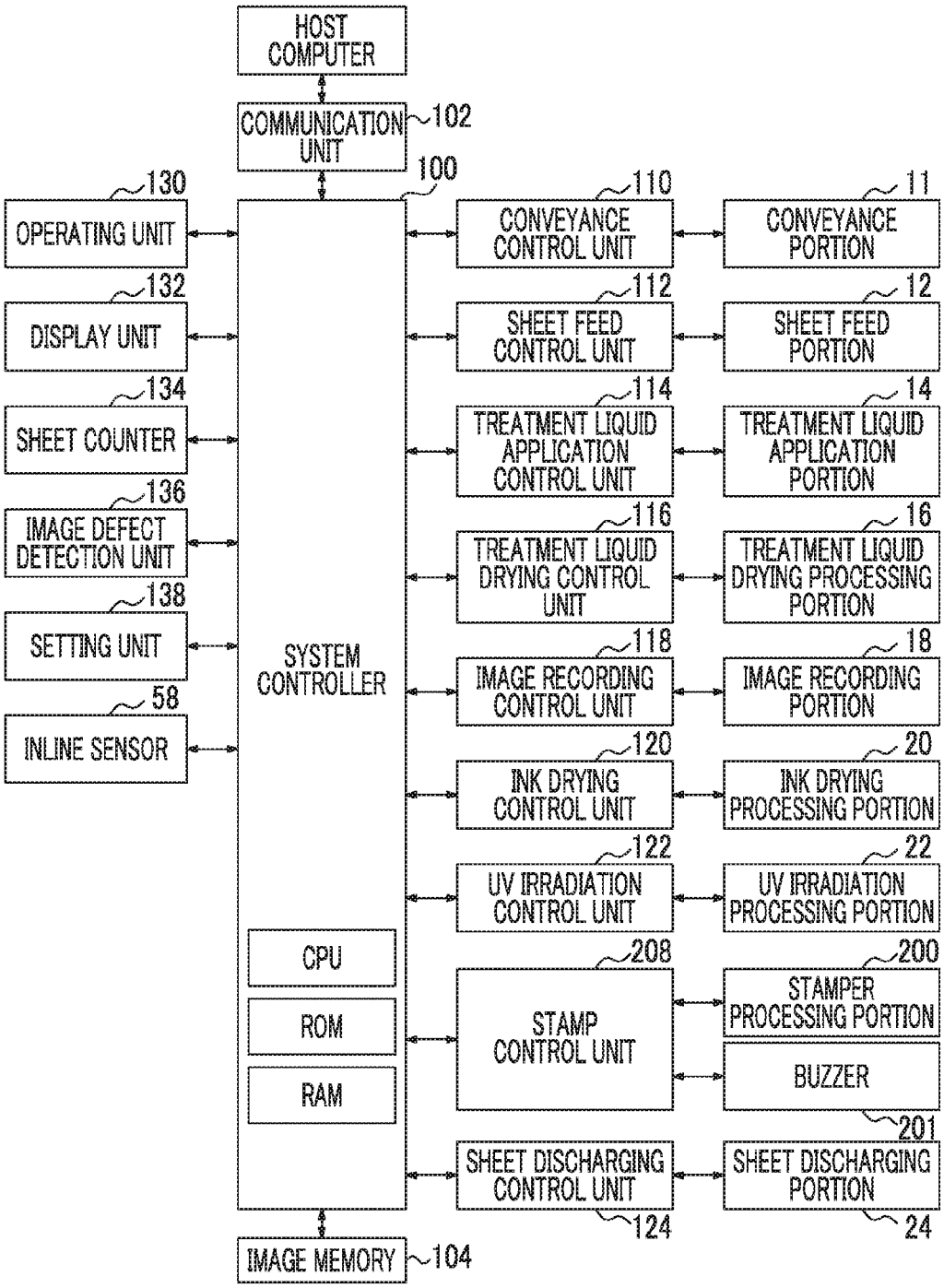
FIG. 4 is a block diagram showing a schematic configuration of a control system of the ink jet recording device.

Based on the imaging results of the inline sensor 58, image defects are detected by an image defect detection unit (not shown in FIG. 1 and indicated by a reference numeral 136 in FIG. 4). Here, the "image defects" include defects due to abnormality in ejection of the ink-jet heads 56C, 56M, 56Y, and 56K, defects due to color drift, and defects due to attachment of foreign substances such as ink mist.

Moreover, the image defects may be abnormality on the sheet P which is detected from the imaging results of the inline sensor 58, and are not limited to the above-described defects such as the defects due to the abnormality in the ejection. A sensor (stain detection unit) which detects stains of the sheet P or the like may be separately provided along with the inline sensor 58 or instead of the inline sensor 58.

In the present example, the aspect is exemplified which uses the imaging results of the inline sensor 58 configured of the line scanner serving as the image defect detection unit or the stain detection unit. However, the present invention is not limited to this, and other configurations and other methods may be applied to the defect detection unit or the stain detection unit.

For example, instead of the inline sensor 58, an aspect including imaging means (high-speed camera) for directly imaging the ejection state in the ink of the ink-jet heads 56C, 56M, 56Y, and 56K may be adopted.

A contact prevention plate 59 is installed so as to be close to the inline sensor 58 on the downstream side of the inline sensor 58. When lifting occurs in the sheet P due to failure of the conveyance or the like, the contact prevention plate 59 prevents the sheet P from coming into contact with the inline sensor 58.

The mist filter 60 is disposed between the rearmost ink-jet head 56K and the inline sensor 58, sucks air around the image recording drum 52, and captures ink mist. In this way, since the mist filter 60 sucks air around the image recording drum 52 and captures ink mist, it is possible to prevent the ink mist from entering the inline sensor 58 and prevent the occurrence of reading defects or the like.

The drum cooling unit 62 blows cold air to the image recording drum 52 so as to cool the image recording drum 52. The drum cooling unit 62 mainly includes an air-conditioner (not shown), and a duct 62A through which cold air supplied from the air-conditioner is blown to the circumferential surface of the image recording drum 52. The cold air is blown to a region except for the conveyance region of the sheet P in the image recording drum 52 through the duct 62A, and the image recording drum 52 is cooled. In the present example, since the sheet P is conveyed along an approximately upper half portion of the image recording drum 52, the duct 62A is configured such that cold air is blown to an approximately lower half portion of the image recording drum 52 through the duct 62A so as to cool the image recording drum 52. Specifically, the duct 62A is configured so that outlets of the duct 62A are formed in an arc shape so as to cover an approximately lower half portion of the image recording drum 52, and cold air is blown to the region of the approximately lower half portion of the image recording drum 52.

Here, a temperature for cooling the image recording drum 52 is determined according to a relationship between the temperatures of the ink-jet heads 56C, 56M, 56Y, and 56K (particularly, the temperatures of the nozzle surfaces) and the temperature for cooling the image recording drum 52, and the image recording drum 52 is cooled so as to be a lower temperature than the temperatures of the ink-jet heads 56C, 56M, 56Y, and 56K. Accordingly, it is possible to prevent condensation from occurring on the ink-jet heads 56C, 56M, 56Y, and 56K. That is, by allowing the temperature of the image recording drum 52 to be lower than the temperatures of the ink-jet heads 56C, 56M, 56Y, and 56K, condensation can be generated on the image recording drum side, and it is possible to prevent condensation (particularly, condensation occurring on the nozzle surface) from occurring on the ink-jet heads 56C, 56M, 56Y, and 56K.

The image recording portion 18 is configured as described above. According to this configuration, the sheet P which is transferred from the treatment liquid drying processing drum 46 of the treatment liquid drying processing portion 16 is received by the image recording drum 52. The image recording drum 52 rotates while holding the leading end of the sheet P by the gripper 52A, and conveys the sheet P. First, the sheet P transferred to the image recording drum 52 passes through the sheet pressing roller 54. Accordingly, the sheet P comes into close contact with the circumferential surface of the image recording drum 52. Simultaneously, the sheet is sucked from the adsorption holes of the image recording drum 52, and is adsorbed and held to the outer circumferential surface of the image recording drum 52. In this state, the sheet P is conveyed and passes through each of the ink-jet heads 56C, 56M, 56Y, and 56K. In addition, when the sheet P passes through each of the ink-jet heads 56C, 56M, 56Y, and 56K, droplets of the ink of each of C, M, Y, and K from the ink-jet heads 56C, 56M, 56Y, and 56K are hit to the surface of the sheet P, and a color image is drawn on the surface. Since the ink flocculation layer is formed on the surface of the sheet P, it is possible to record high-quality images without generating feathering, bleeding, or the like.

Next, the sheet P, on which the images are recorded by the ink-jet heads 56C, 56M, 56Y, and 56K, passes through the inline sensor 58. In addition, when the sheet P passes through the inline sensor 58, the images recorded on the surface are read. The reading of the recorded images is performed on all sheets P. Since the reading is performed in the state where the sheet P is adsorbed and held to the image recording drum 52 when the reading is performed, it is possible to perform the reading with high accuracy. In addition, since the reading is performed immediately after the images are recorded, it is possible to immediately detect abnormality such as ejection defects, and it is possible to rapidly cope with the defects. Accordingly, it is possible to prevent the sheets P from being recorded wastefully, and it possible to minimize the occurrence of waste paper.

Thereafter, after the adsorption of the sheet P is released, the sheet P is transferred to the ink drying processing portion 20.

<Ink Drying Processing Portion>

The ink drying processing portion 20 performs drying processing on the sheet P after the image recording is performed, and removes a liquid component remaining on the surface of the sheet P. The ink drying processing portion 20 includes a chain gripper 64 which conveys the sheet P on which the images are recorded, a back tension application mechanism 66 which applies back tension to the sheet P conveyed by the chain gripper 64, and an ink drying processing unit 68 which performs the drying processing on the sheet P which is conveyed by the chain gripper 64.

The chain gripper 64 is a sheet conveyance mechanism which is commonly used in the ink drying processing portion 20, the UV irradiation processing portion 22, the stamper processing unit 200, and the sheet discharging portion 24, and conveys the sheet P transferred from the image recording portion 18 to the sheet discharging portion 24.

The chain gripper 64 mainly includes a first sprocket 64A which is disposed so as to be close to the image recording drum 52, a second sprocket 64B which is installed in the sheet discharging portion 24, an endless chain 64C which is wound around the first sprocket 64A and the second sprocket 64B, a plurality of chain guides (not shown) which guide traveling of the chain 64C, and a plurality of grippers 64D which are attached to the chain 64C with predetermined intervals. Each of the first sprocket 64A, the second sprocket 64B, the chain 64C, and the chain guide is configured in a pair, and is disposed on both sides in a width direction of the sheet P. The plurality of grippers 64D are provided between the pair of chains 64C, and both end portions of the leading end edge (indicated by a reference numeral $P_1$ in FIG. 2) of the sheet P are held by the plurality of grippers 64D.

The first sprocket 64A is installed so as to be close to the image recording drum 52 such that the sheet P transferred from the image recording drum 52 can be received by the plurality of grippers 64D. The first sprocket 64A is journaled by a bearing (not shown) so as to be rotatably provided, and is connected to a motor (not shown). The chain 64C, which is wound around the first sprocket 64A and the second sprocket 64B, is travelled by driving the motor.

The second sprocket 64B is installed in the sheet discharging portion 24 such that the sheet P received from the image recording drum 52 can be recovered by the sheet discharging portion 24. That is, the installation position of the second sprocket 64B is positioned at the terminal of the route of the conveyance of the sheet P performed by the chain gripper 64. The second sprocket 64B is journaled by a bearing (not shown) so as to be rotatably provided.

The chain 64C is formed in an endless shape, and is wound around the first sprocket 64A and the second sprocket 64B.

The chain guide is disposed at a predetermined position and guides the chain 64C such that the chain 64C travels a predetermined route (=guides the sheet P such that the sheet P travels a predetermined conveyance route). In the ink jet recording device 10 of the present example, the second sprocket 64B is disposed at a higher position than the position of the first sprocket 64A. Accordingly, a traveling route in which the chain 64C is inclined midway is formed. Specifically, the traveling route is configured of a first horizontal conveyance route 70A, an inclination conveyance route 70B, and a second horizontal conveyance route 70C.

The first horizontal conveyance route 70A is provided at the same height as the height of the first sprocket 64A, and is set such that the chain 64C wound around the first sprocket 64A travels horizontally.

The second horizontal conveyance 70C is provided at the same height as the height of the second sprocket 64B, and is set such that the chain 64C wound around the second sprocket 64B travels horizontally.

The inclination conveyance route 70B is set between the first horizontal conveyance route 70A and the second horizontal conveyance route 70C, and is set so as to connect a portion between the first horizontal conveyance route 70A and the second horizontal conveyance route 70C.

The chain guide is disposed so as to form the first horizontal conveyance route 70A, the inclination conveyance route 70B, and the second horizontal conveyance route 70C. Specifically, the chain guide is disposed in at least a joining point between the first horizontal conveyance route 70A and the inclination conveyance route 70B, and a joining point between the inclination conveyance route 70B and the second horizontal conveyance route 70C.

The plurality of pairs of grippers 64D are attached to the chain 64C with predetermined intervals. The attachment intervals of the grippers 64D are set so as to be matched to receiving intervals of the sheet P from the image recording drum 52. That is, the attachment intervals of the grippers 64D are set so as to be matched to the receiving intervals of sheets P from the image recording drum 52 such that the sheet P which is sequentially transferred from the image recording drum 52 can be received from the image recording drum 52 according to the timing.

The chain gripper 64 is configured as described above. According to this configuration, as described above, if the motor (not shown) connected to the first sprocket 64A is driven, the chain 64C travels. The chain 64C travels at the same speed as the circumferential speed of the image recording drum 52. In addition, the timing is matched such that the sheet P transferred from the image recording drum 52 is received by each gripper 64D.

The back tension application mechanism 66 applies back tension to the sheet P which is conveyed in the state where the leading end of the sheet P is held by the chain gripper 64. The back tension application mechanism 66 mainly includes a guide plate 72 and a suction mechanism (not shown) which sucks air from a suction hole (not shown) formed on the guide plate 72.

The guide plate 72 is configured of a hollow box plate having a width corresponding to the width of the sheet. The guide plate 72 is disposed along the conveyance route of the sheet P (traveling route of the chain) by the chain gripper 64. Specifically, the guide plate 72 is disposed along the chain 64C which travels the first horizontal conveyance route 70A and the inclination conveyance route 70B, and is disposed to be separated at a predetermined distance from the chain 64C. The sheet P which is conveyed by the chain gripper 64 is conveyed while the rear surface (the surface on which the image is not recorded) of the sheet P slides on the upper surface (the surface facing the chain 64C: sliding surface) of the guide plate 72.

A plurality of suction holes (not shown) are formed on the sliding surface (upper surface) of the guide plate 72 in a predetermined pattern. As described above, the guide plate 72 is formed in a hollow box plate. A suction mechanism (not shown) sucks air in the hollow portion (inner portion) of the guide plate 72. Accordingly, air is sucked from the suction holes formed on the sliding surface.

Since air is sucked from the suction holes of the guide plate 72, the rear surface of the sheet P conveyed by the chain gripper 64 is sucked to the suction holes. Accordingly, back tension is applied to the sheet P which is conveyed by the chain gripper 64.

As described above, since the guide plate 72 is disposed along the chain 64C which travels the first horizontal conveyance route 70A and the inclination conveyance route 70B, back tension is applied to the sheet P while the sheet P is conveyed to the first horizontal conveyance route 70A and the inclination conveyance route 70B.

The ink drying processing unit 68 is installed inside the chain gripper 64 (particularly, in a portion which configures the first horizontal conveyance route 70A) and performs drying processing on the sheet P which is conveyed to the first horizontal conveyance route 70A. The ink drying processing unit 68 blows hot air to the surface of the sheet P which is conveyed to the first horizontal conveyance route 70A and performs drying processing on the surface of the sheet P. The plurality of ink drying processing units 68 are disposed along the first horizontal conveyance route 70A. The number of the installed ink drying processing units 68 is set according to a processing capacity of the ink drying processing unit 68, a conveyance speed (printing speed) of the sheet P, or the like. That is, the number of the ink drying processing units 68 is set such that the sheet P which is received from the image recording portion 18 can be dried while being transferred to the first horizontal conveyance route 70A. Accordingly, a length of the first horizontal conveyance route 70A is also set in consideration of the capacity of the ink drying processing unit 68.

In addition, by performing the drying processing, humidity of the ink drying processing portion 20 increases. Since it is not possible to effectively perform the drying processing if the humidity increases, in order to forcibly exhaust moist air which is generated by the drying processing, preferably, exhaust means is installed in the ink drying processing portion 20 along with the ink drying processing unit 68. For example, the exhaust means may be a configuration in which an exhaust duct is installed in the ink drying processing portion 20 and air in the ink drying processing portion 20 is exhausted by the exhaust duct.

The ink drying processing portion 20 is configured as described above. According to this configuration, the sheet P transferred from the image recording drum 52 of the image recording portion 18 is received by the chain gripper 64. The chain gripper 64 holds the leading end of the sheet P by the grippers 64D and conveys the sheet P along a planar guide plate 72. First, the sheet transferred to the chain gripper 64 is conveyed to the first horizontal conveyance route 70A. In the process in which the sheet is conveyed to the first horizontal conveyance route 70A, the ink drying processing unit 68 installed inside the chain gripper 64 performs the drying processing on the sheet P. That is, hot air is blown to the surface (image forming surface) of the sheet P, and the drying processing is performed. In this case, the drying processing is performed while back tension is applied to the sheet P by the back tension application mechanism 66. Accordingly, it is possible to perform the drying processing while preventing deformation of the sheet P.

<UV Irradiation Processing Portion>

The UV irradiation processing portion 22 irradiates the image recorded using the aqueous UV ink with ultraviolet (UV) so as to fix the image to the sheet P. The UV irradiation processing portion 22 mainly includes the chain gripper 64 which conveys the dried sheet P, the back tension application mechanism 66 which applies back tension to the sheet P conveyed by the chain gripper 64, and a UV irradiation unit 74 which irradiates the sheet P conveyed by the chain gripper 64 with ultraviolet.

As described above, the chain gripper 64 and the back tension application mechanism 66 are commonly used in the ink drying processing portion 20 and the sheet discharging portion 24.

The UV irradiation unit 74 is installed inside the chain gripper 64 (particularly, in a portion which configures the inclination conveyance route 70B), and irradiates the surface of the sheet P conveyed to the inclination conveyance route 70B with ultraviolet. The UV irradiation unit 74 includes an ultraviolet lamp (UV lamp), and the plurality of UV irradiation units 74 are disposed along the inclination conveyance route 70B. In addition, the surface of the sheet P conveyed to the inclination conveyance route 70B is irradiated with ultraviolet. The number of installed UV irradiation units 74 is set according to the conveyance speed (=printing speed) of the sheet P. That is, the number of the installed irradiation units 74 is set such that the image can be fixed by ultraviolet emitted while the sheet P is conveyed to the inclination conveyance route 70B. Accordingly, a length of the inclination conveyance route 70B is also set in consideration of the conveyance speed of the sheet P or the like.

The UV irradiation processing portion 22 is configured as described above. According to this configuration, the sheet P, which is conveyed to the chain gripper 64 and subjected to the drying processing by the ink drying processing portion 20, is conveyed to the inclination conveyance route 70B. In the process in which the sheet P is conveyed to the inclination conveyance route 70B, the UV irradiation unit 74 installed inside the chain gripper 64 performs the UV irradiation processing on the sheet P. That is, ultraviolet is emitted from the UV irradiation unit 74 toward the surface of the sheet P. In this case, the UV irradiation processing is performed on the sheet P while back tension is applied to the sheet P by the back tension application mechanism 66. Accordingly, it is possible to perform the irradiation processing while preventing deformation of the sheet P. In addition, since the UV irradiation processing portion 22 is installed in the inclination conveyance route 70B and the inclined guide plate 72 is installed in the inclination conveyance route 70B, even when the sheet P falls from the gripper 64D during the conveyance, the sheet P slides on the guide plate 72 so as to be discharged.

<Stamper Processing Unit>

The stamper processing unit 200 is provided on the downstream side of the UV irradiation processing portion 22 in the conveyance direction of the sheet P and on the upstream side of the sheet discharging portion 24 in the conveyance direction, and attaches ink to the leading end edge $P_1$ (refer to FIG. 2) of the sheet P in which image defects occur or to the leading end edge $P_1$ of the sheet P corresponding to the sorting number of copies. Accordingly, specification of the defective sheet P from the sheets P loaded on the sheet discharging portion 24 or a classification division managing the sorting number of copies is performed.

In addition, in the present embodiment, the stamper processing unit 200 is provided on the downstream side of the UV irradiation processing portion 22. However, the stamper processing unit 200 can be disposed in any structure of a conveyance portion which is positioned on the downstream side of the image recording portion 18 and in which the stamper processing unit 200 can be disposed (the details will be described below).

<Sheet Discharging Portion>

The sheet discharging portion 24 recovers the sheets P which are subjected to a series of imaging recording processing. The sheet discharging portion 24 mainly includes the chain gripper 64 which conveys the sheet P irradiated with ultraviolet and a sheet discharging stand 76 which stacks and recovers the sheet P.

As described above, the chain gripper 64 is commonly used in the ink drying processing portion 20, the stamper processing unit 200, and the UV irradiation processing portion 22. The chain gripper 64 releases the sheet P above the sheet discharging stand 76, and stacks the sheets P on the sheet discharging stand 76.

The sheet discharging stand 76 stacks and recovers the sheet P which is released from the chain gripper 64. In order to orderly stack the sheet P, a sheet abutment (not shown) (front sheet abutment, rear sheet abutment, lateral sheet abutment, or the like) is provided in the sheet discharging stand 76.

In addition, the sheet discharging stand 76 is liftably provided by a sheet discharging stand ascending and descending device (not shown). The driving of the sheet discharging stand ascending and descending device is controlled so as to be interlocked with an increase or a decrease of the sheets P stacked on the sheet discharging stand 76, and lifts or lowers the sheet discharging stand 76 so that the sheet P positioned at the highest position always has a constant height.

<<Detailed Description of Stamper Processing Unit>>

Figure 2:
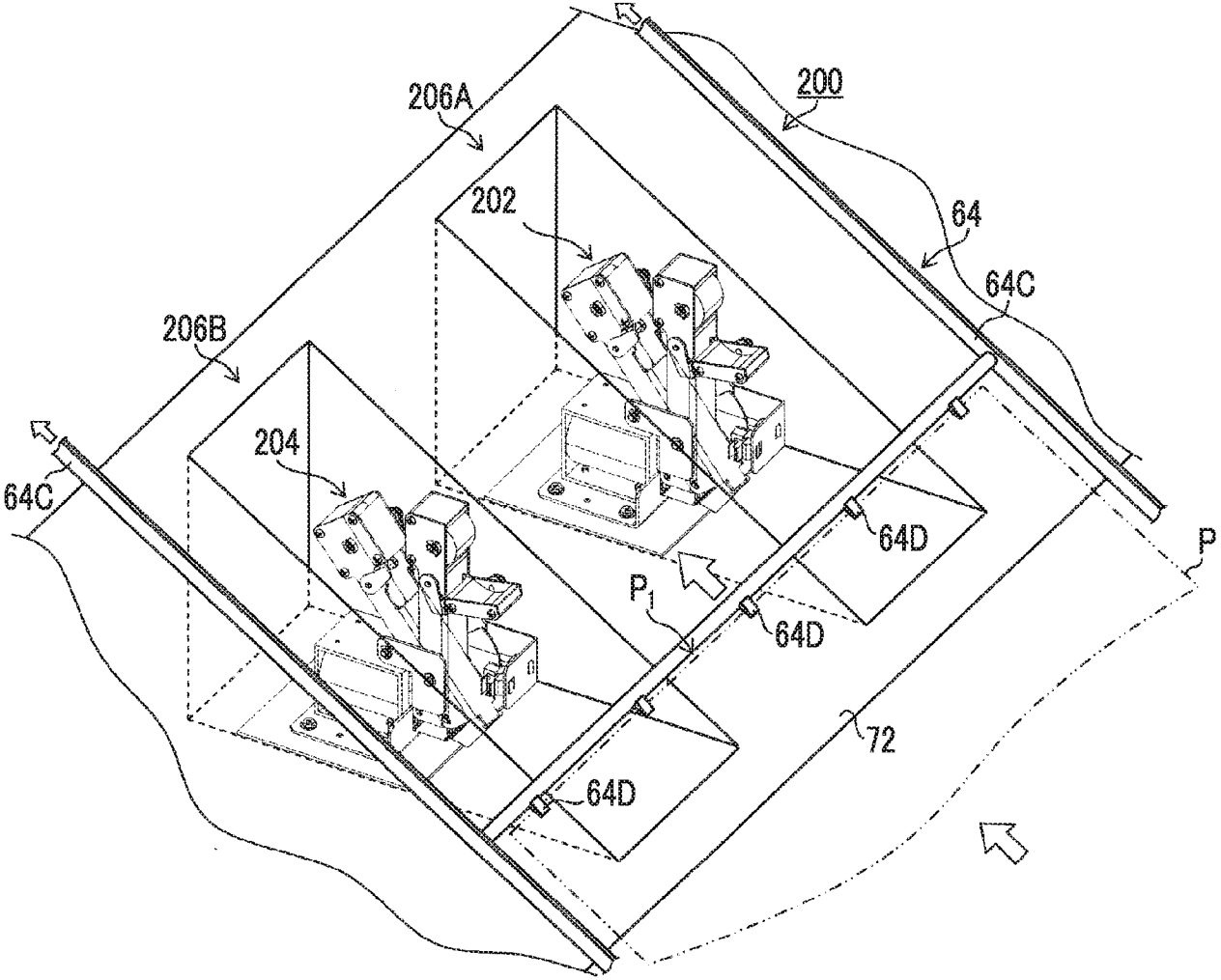
FIG. 2 is a perspective view showing a disposition example of a stamper processing unit in FIG. 1.
Figure 3:
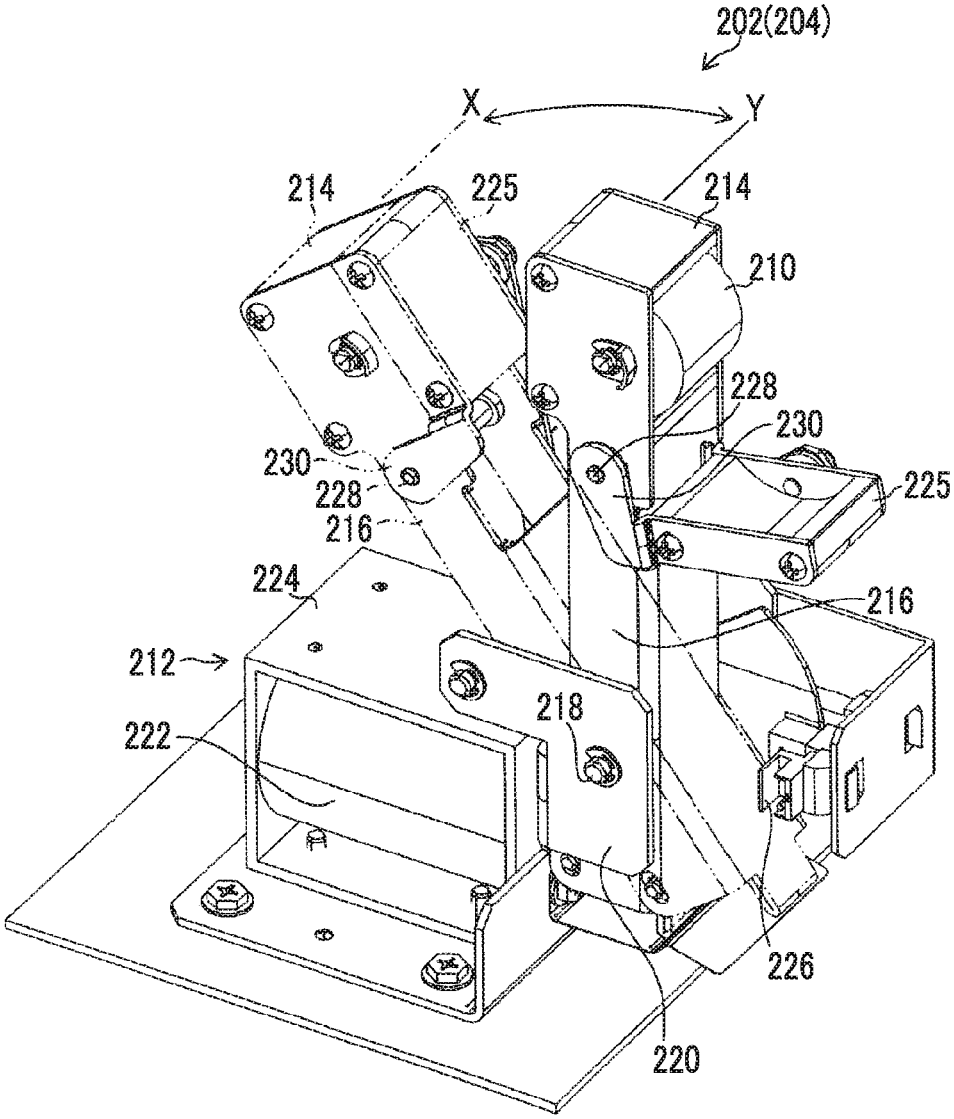
FIG. 3 is an overall configuration view showing a configuration of a first (second) stamper unit.

FIG. 2 is a perspective view showing a disposition example of the stamper processing unit 200, and FIG. 3 is an overall configuration of a first stamper unit 202 (a second stamper unit 204) configuring the stamper processing unit 200. In addition, in FIG. 2, for convenience of illustration, reference numerals indicating the configurations of the first stamper unit 202 and the second stamper unit 204 are omitted.

As shown in FIG. 2, the stamper processing unit 200 is configured so as to include the first stamper unit 202 and the second stamper unit 204. The first stamper unit 202 and the second stamper unit 204 are accommodated in casings 206A and 206B (shown by broken lines) in which the upper surfaces are obliquely opened along the inclination conveyance route 70B of the chain gripper 64, and the casings 206A and 206B are disposed at a position below the inclination conveyance route 70B.

A length in which widths of the casings 206A and 206B are added is less than disposition widths of the plurality of chain grippers 64. Accordingly, the first stamper unit 202 and the second stamper unit 204 are disposed between the pair of chains 64C. In addition, the first stamper unit 202 and the second stamper unit 204 are disposed between the grippers in the width direction of the sheet P.

The first stamper unit 202 and the second stamper unit 204 are disposed such that stamp positions with respect to the sheet P are positioned at the same position in the conveyance direction of the sheet P. The first stamper unit 202 and the second stamper unit 204 may be disposed so as to be deviated in the conveyance direction of the sheet P.

In addition, here, the "same position" includes "substantially the same position" at which the same effects can be obtained.

Since the first stamper unit 202 and the second stamper unit 204 are disposed at positions different from each other in the width direction of the sheet P orthogonal to the conveyance direction of the sheet P, ink attachment positions in the width direction of the sheet P do not overlap each other.

In addition, in the present specification, "orthogonal" includes being substantially orthogonal to each other in intersecting each other at an angle less than 90° or more than 90°.

Based on command signals sent from a stamp control unit (not shown in FIGS. 2 and 3 and indicated by a reference numeral 208 in FIG. 4), the first stamper unit 202 attaches ink to the leading end edge $P_1$ of the sheet P in which it has been determined that image defects occur in the sheet P based on the reading results of the inline sensor 58 (refer to FIG. 1).

Based on command signals from the stamp control unit (refer to FIG. 4), the second stamper unit 204 attaches ink to the leading end edge $P_1$ of the sheet P corresponding to the classification division based on the preset sorting number of copies.

That is, the first stamper unit 202 functions as a defect stamper which classifies the sheet P on which defective images are printed, and the second stamper unit 204 functions as a sheet number stamper which performs classification for each predetermined number of sheets.

Preferably, the color (kind) of the ink of the first stamper unit 202 is different from the color (kind) of the ink of the second stamper unit 204. Accordingly, it is possible to easily determine whether the ink attached to the sheet P is the ink indicating the sheet defects or the ink indicating the sorting number of copies.

Here, the "ink color" may include a transparent color or the same color (for example, white) as the sheet P. In addition, a case where densities are different from each other in the same color (normal ink and light ink) is included in the ink in which the colors are different from each other. The kinds (particularly, having visual characteristics different from each other) of the ink may be different from each other.

Next, structures of the first stamper unit 202 and the second stamper unit 204 will be described with reference to FIGS. 2 and 3. In addition, the same configuration may be applied to the first stamper unit 202 and the second stamper unit 204. In descriptions below, the first stamper unit 202 is described as a representative of the first stamper unit 202 and the second stamper unit 204.

In addition, here, the "same" includes "substantially the same" capable of obtaining the similar effects even when a portion of configurations are different from each other.

As shown in FIGS. 2 and 3, the first stamper unit 202 (second stamper unit 204) is configured so as to mainly include a stamp roller 210 (stamp portion) into which ink is impregnated, and a retractable mechanism 212 which causes the stamp roller 210 to protrude toward the chain gripper 64 and retracts the stamp roller 210 from the chain gripper 64.

The stamp roller 210 is rotatably supported in a stamp container 214, and the stamp container 214 is supported by the retractable mechanism 212.

The retractable mechanism 212 is configured so as to mainly include an arm 216 (stamp movement portion) which supports the stamp container 214 at the tip portion of the arm 216, a support plate 220 (stamp movement portion) which rotatably supports the arm 216 via a rotary shaft 218, and a solenoid actuator 222 (stamp movement portion) which rotates the arm 216 about the rotary shaft 218 and moves the stamp container 214 between a standby position X and a stamp position Y.

In FIGS. 2 and 3, the stamp container 214 or the like, which is positioned at the standby position X and is retracted so as not to protrude from openings of the casings 206A and 206B, is shown by two-dot chain lines, and the stamp container 214 or the like, which is positioned at the stamp position Y and extends so as to protrude from the openings of the casings 206A and 206B, is shown by a solid line.

In a relationship among the arm 216, the support plate 220, and the solenoid actuator 222, the arm 216 is rotatably supported by the support plate 220, the support plate 220 is supported by an outer frame portion 224 of the solenoid actuator 222, the outer frame portion 224 is fixed to bottom surfaces of the casings 206A and 206B, and a mutual support structure is formed.

In addition, when the arm 216 is formed of a member such as a resin which is not adsorbed by a magnetic force of a solenoid except for metal which can be adsorbed with respect to the magnetic force of the solenoid, a metal plate for adsorption is attached to a base end portion of the arm 216.

ON-OFF of the solenoid actuator 222 is controlled based on the command signals sent from the stamp control unit (refer to FIG. 4). That is, when the solenoid actuator 222 is turned on, excitation current flows to a coil (not shown) in the solenoid actuator 222, a magnetic field is generated by the excitation current, and the base end portion of the arm 216 is pulled toward the solenoid actuator 222 by the effects of the magnetic field.

Accordingly, the arm 216 which stands-by in an inclined state is erected, the stamp container 214 supported by the tip portion of the arm 216 moves from the standby position X to the stamp position Y, and the stamp container 214 appears from the lower portion of the chain gripper 64 to the upper portion (from the openings of the casings 206A and 206B).

Since the first stamper unit 202 has a latch mechanism which holds the state of the arm 216 which is erected once, even after the excitation current flowing to the coil of the solenoid actuator 222 is turned off and the magnetic field is removed, the erection state of the arm 216 is held.

The stamp container 214 includes an opening/closing lid 225 which is opened and closed so as to be interlocked with the retractable mechanism 212, exposes the stamp surface of the stamp roller 210 from the stamp container 214, and seals the stamp roller 210. An opening/closing mechanism of the opening/closing lid 225 includes an optical sensor 226 (position detection unit) which detects a base end portion position (home position) of the arm 216, and an opening/closing actuator (not shown) which opens and closes the opening/closing lid 225 based on the detected results of the optical sensor 226.

That is, if the arm 216 moves to the stamp position Y and the base end portion of the arm 216 is not detected by the optical sensor 226 (OFF state), the opening/closing actuator is driven so as to open the opening/closing lid 225.

In addition, if the arm 216 moves to the standby position X and the base end portion of the arm 216 is detected by the optical sensor 226 (OFF state), the opening/closing actuator is driven so as to close the opening/closing lid 225. In other words, the opening/closing mechanism is configured so as to open and close the opening/closing lid 225 to be interlocked with the protrusion and the retraction of the stamp container 214 according to the rotation of the arm 216.

Moreover, as an example of the opening/closing mechanism of the opening/closing lid 225, a method may be adopted, in which the opening/closing lid 225 is open and closed when the opening/closing lid 225 is supported by a support arm 230 via a rotation pin 228 with respect to the stamp container 214 and the rotation pin 228 is rotated by a motor.

In addition, the sheet P is conveyed in a direction indicated by a white arrow in FIG. 2, the leading end edge $P_1$ of the sheet P abuts the stamp roller 210 (the open/closing lid of the stamp container is open), and ink is attached to the leading end edge $P_1$.

The solenoid actuator 222 is turned off immediately before the sheet P abuts the stamp roller 210, and the arm 216 falls by a force generated when the sheet P abuts the stamp container 214. Accordingly, the stamp container 214 is retracted below the chain gripper 64 (is accommodated in the casings 206A and 206B), and a normal conveyance of the sheet P which is sequentially conveyed is not interfered with.

The first stamper unit 202 includes a stopper mechanism (not shown) which stops the arm 216 at the standby position X.

In addition, in the present embodiment, the retractable mechanism of the stamp container 214 has the configuration in which the arm is rotated such that the arm rises and falls, and the stamp roller 210 protrudes toward or retracts from the chain gripper 64. However, if similar operations can be performed, the present invention is not limited to the configuration.

<<Control System>>

FIG. 4 is a block diagram showing a schematic configuration of a control system of the ink jet recording device 10 of the present embodiment.

As shown in FIG. 4, the ink jet recording device 10 includes a system controller 100, a communication unit 102, an image memory 104, a conveyance control unit 110, a sheet feed control unit 112, a treatment liquid application control unit 114, a treatment liquid drying control unit 116, an image recording control unit 118, an ink drying control unit 120, a UV irradiation control unit 122, a stamp control unit 208 (first stamp control unit and second stamp control unit), a sheet discharging control unit 124, an operating unit 130, a display unit 132, a sheet counter 134, or the like.

The system controller 100 functions as control means for totally controlling each portion of the ink jet recording device 10, and functions as calculation means for performing various calculation processing. The system controller 100 includes a Central Processing Unit (CPU), a Read Only Memory (ROM), a Random Access Memory (RAM), or the like, and is operated according to a predetermined control program. A control program executed by the system controller 100 and various data required for the control are stored in the ROM.

The communication unit 102 includes a required communication interface, and sends and receives data between a host computer connected to the communication interface and the communication unit 102.

The image memory 104 functions as means for temporarily storing various data including image data, and data is read from and written to the image memory 104 via the system controller 100. The image data which is received from the host computer via the communication unit 102 is stored in the image memory 104.

The conveyance control unit 110 controls the conveyance portion 11 of the sheet P in the ink jet recording device 10. That is, the conveyance control unit 110 controls the driving of the tape feeder 36A, the front abutment 38, the sheet feed drum 40 in the sheet feed portion 12, the driving of the treatment liquid application drum 42 in the treatment liquid application portion 14, the driving of the treatment liquid drying processing drum 46 in the treatment liquid drying processing portion 16, and the driving of the image recording drum 52 in the image recording portion 18. In addition, the conveyance control unit 110 controls the driving of the chain gripper 64 and the back tension application mechanism 66 which are commonly used in the ink drying processing portion 20, the UV irradiation processing portion 22, and the sheet discharging portion 24.

The conveyance control unit 110 controls the conveyance portion 11 according to a command of the system controller 100, and controls the conveyance portion 11 such that the sheet P is smoothly conveyed from the sheet feed portion 12 to the sheet discharging portion 24.

The sheet feed control unit 112 controls the sheet feed portion 12 according to the command of the system controller 100. Specifically, the sheet feed control unit 112 controls the driving of the sucker device 32, the sheet feed rack ascending and descending mechanism, or the like such that the sheets P loaded on the sheet feed rack 30 are fed in order one by one without overlapping each other.

The treatment liquid application control unit 114 controls the treatment liquid application portion 14 according to the command from the system controller 100. Specifically, the treatment liquid application control unit 114 controls the driving of the treatment liquid application unit 44 such that the sheet P conveyed by the treatment liquid application drum 42 is coated with the treatment liquid.

The treatment liquid drying control unit 116 controls the treatment liquid drying processing portion 16 according to the command from the system controller 100. Specifically, the treatment liquid drying control unit 116 controls the driving of the treatment liquid drying processing unit 50 such that drying processing is performed on the sheet P conveyed by the treatment liquid drying processing drum 46.

The image recording control unit 118 controls the image recording portion 18 according to the command from the system controller 100. Specifically, the image recording control unit 118 controls the driving of the ink-jet heads 56C, 56M, 56Y, and 56K such that a predetermined image is recorded on the sheet P which is conveyed by the image recording drum 52. In addition, the image recording control unit 118 controls the operation of the inline sensor 58 such that the recorded image is read.

The ink drying control unit 120 controls the ink drying processing portion 20 according to the command from the system controller 100. Specifically, the ink drying control unit 120 controls the driving of the ink drying processing unit 68 such that hot air is blown to the sheet P which is conveyed by the chain gripper 64.

The UV irradiation control unit 122 controls the UV irradiation processing portion 22 according to the command from the system controller 100. Specifically, the UV irradiation control unit 122 controls the driving of the UV irradiation unit 74 such that the sheet P conveyed by the chain gripper 64 is irradiated with ultraviolet.

The stamp control unit 208 controls the operations of the stamper processing unit 200 (the first stamper unit 202 and the second stamper unit 204 shown in FIGS. 2 and 3) and a buzzer 201 according to the command from the system controller 100.

The sheet discharging control unit 124 controls the sheet discharging portion 24 according to the command from the system controller 100. Specifically, the sheet discharging control unit 124 controls the driving of the sheet discharging stand ascending and descending mechanism or the like such that the sheets P are stacked (loaded) on the sheet discharging stand 76.

The operating unit 130 includes required operating means (for example, an operating button, a keyboard, a touch panel, or the like), and outputs operating information which is input from the operating means to the system controller 100.

The system controller 100 performs various processing according to the operating information input from the operating unit 130.

For example, when the number of copies of the sheets P loaded on the sheet discharging portion 24 is sorted every one hundred, the sorting number of copies is input from the operating unit 130. The input sorting number of copies is stored as the setting value of the sorting number of copies. The setting value of the sorting number of copies is read by the stamp control unit 208, and is applied to the control of the stamper processing unit 200.

The setting unit 138 shown in FIG. 4 is a block which performs various setting such as the setting of the sorting number of copies, and is configured so as to include a setting value acquisition unit which acquires the setting, a setting value storage unit which stores the acquired setting value, and a storage control unit which controls writing and reading of the setting value stored in the setting value storage unit.

The display unit 132 includes a required display unit (for example, a Liquid Crystal Display (LCD) panel or the like), and displays the required information on the display station according to the command from the system controller 100.

The sheet counter 134 is means for measuring the number of sheets P which are fed from the sheet feed portion 12. The information on the number of sheets P obtained from the sheet counter 134 is sent to the stamp control unit 208 via the system controller 100, and is applied to the control of the stamper processing unit 200.

The image defect detection unit 136 detects whether or not defects occur on the image formed on the sheet P. The presence or absence of the image defects is determined based on the imaging results of the inline sensor 58. The detection results are sent to the stamp control unit 208 via the system controller 100, and are applied to the control of the stamper processing unit 200. In addition, as described above, the stain detection unit which detects stains of the sheet P is provided, and the stains of the sheet P may be determined as the image defects.

The buzzer 201 is means for sounding an alarm during a predetermined period of time ($t_3$ in FIG. 5) based on the control of the stamp control unit 208 when stamp performance conditions of the first stamper unit 202 are satisfied. In addition, instead of the buzzer 201 or along with the buzzer 201, it is possible to apply lighting, blinking, extinction of a lamp, or displaying character information on a display unit.

<<Description of Image Recording>>

The ink jet recording device 10 receives the image data recorded on the sheet via the communication unit 102 from a host computer. The received image data is stored in the image memory 104.

The system controller 100 performs required signal processing on the image data stored in the image memory 104, and generates dot data. In addition, the system controller 100 controls the driving of each of the ink-jet heads 56C, 56M, 56Y, and 56K of the image recording portion 18 according to the generated dot data, and records the image indicating the image data on the sheet.

In general, the dot data is generated by performing color conversion processing and half-tone processing on the image data. In the color conversion processing, the image data represented by standard RGB (sRGB) or the like (for example, image data of RGB 8 bit) is converted into ink amount data of each color in the ink used in the ink jet recording device 10 (in the present example, converted into the ink amount data of each of C, M, Y, and K). In the half-tone processing, the ink amount data of each color which is generated by the color conversion processing is converted into dot data of each color by processing such as error diffusion.

The system controller 100 performs the color conversion processing and the half-tone processing on the image data to generate dot data of each color. In addition, the system controller 100 controls the driving of the corresponding ink-jet head according to the generated dot data of each color, and records the image indicating the image data on the sheet P.

<<Description of Operation and Control of Stamper Processing Unit>>

Next, the operation and the control of the stamper processing unit 200 (the first stamper unit 202 and the second stamper unit 204) will be described in detail.

<First Stamper Unit>

Figure 5:
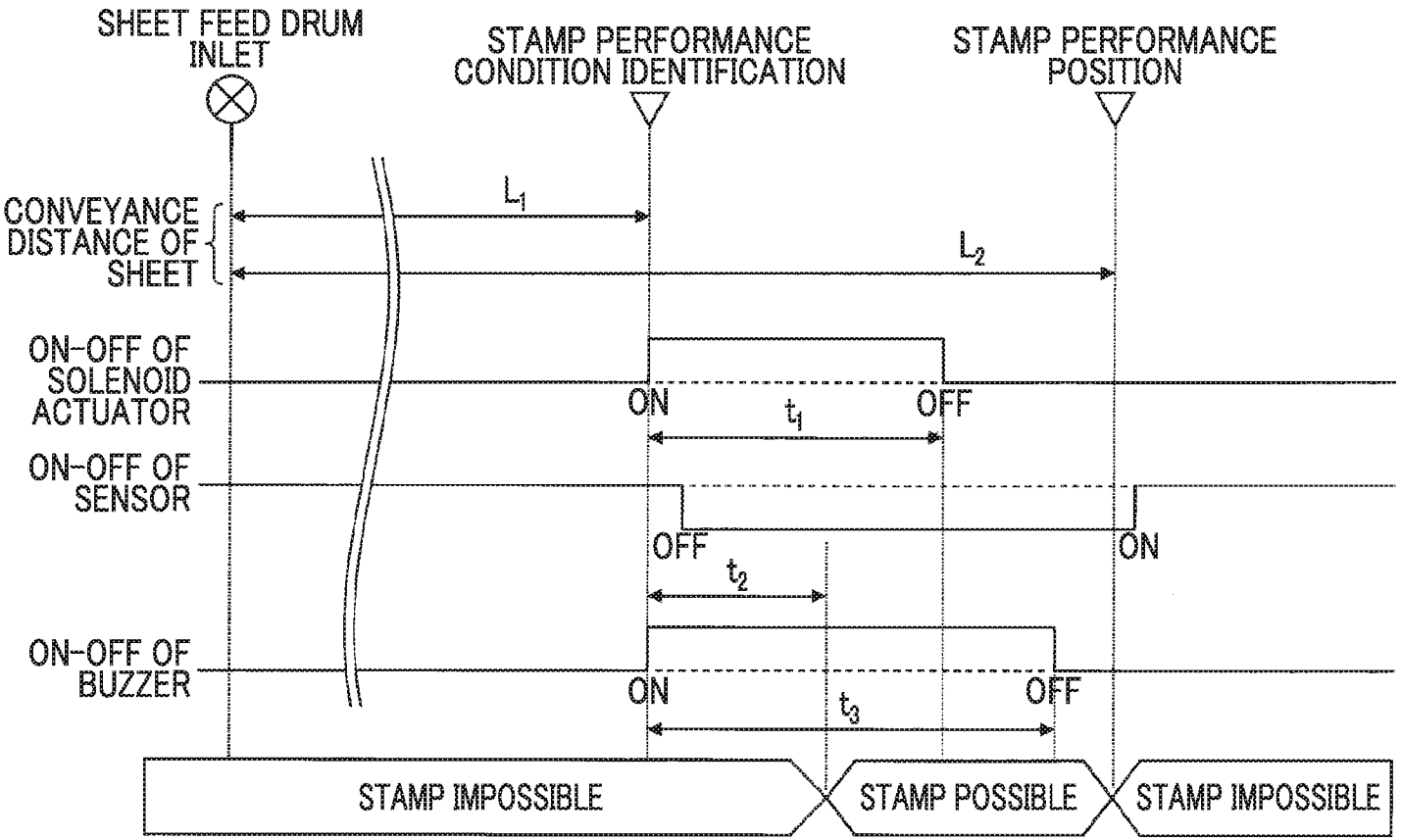
FIG. 5 is an explanatory view of a control of the first stamper unit.

FIG. 5 is an explanatory view showing a control example of the first stamper unit 202 (refer to FIGS. 2 and 3). In FIG. 5, a direction from the left toward the right is an advancing direction of the sheet P and is an advancing direction of the control (advancing direction of time).

In the first stamper unit 202 shown in the present example, if the stamp performance conditions are satisfied at an identification position (timing) of the stamp performance conditions, the first stamper unit 202 attaches ink to the leading end edge $P_1$ of the sheet P and sounds the buzzer 201 (refer to FIG. 4) during the predetermined period of time ($t_3$). In addition, the buzzer 201 is not sounded when the stamp is performed.

The stamp performance conditions of the first stamper unit 202 include a case where "the sheet P having image defects occurs", and specifically, include image abnormality (color drift, or the like), ejection abnormality, purge due to conveyance abnormality of the sheet P, or the like. In addition, when the sheet P moves in a direction opposite to a normal conveyance direction and thereafter, is conveyed in the normal conveyance direction, stamping is not performed on the stamped sheet P.

As shown in FIG. 5, a distance, in which the sheet P is conveyed from an inlet of the sheet feed drum 40 until the stamp performance conditions of the first stamper unit 202 are identified, is defined as $L_1$. A distance, in which the sheet P conveyed from an inlet of the sheet feed drum 40 to the stamp performance position at which the first stamper unit 202 performs stamping on the sheet P, is defined as $L_2$.

A distance ($L_2$–$L_1$) or a period which is required to be secured from identification of the stamp performance conditions to the stamp performance is calculated based on the distance $L_1$ on the sheet conveyance path from the sheet feed drum 40 to the identification position of the stamp performance conditions, the conveyance speed of the sheet P, the size of the used sheet P (particularly, the size in the conveyance direction), a response period (response time) of the solenoid actuator 222 (refer to FIGS. 2 and 3), an excitation period of the solenoid actuator 222, variation in the grip positions with respect the sheet P when both sides of the leading end of the sheet P are gripped by the gripper 64D, or the like.

A rotary encoder is mounted on the sheet feed drum 40, a Z-phase output (pulse signal which is output once per one rotation) of the rotary encoder corresponds to a transfer timing of the sheet P of the sheet feed drum 40.

The identification position of the stamp performance conditions is positioned on the downstream side of the inline sensor 58 of FIG. 1 in the sheet conveyance direction and the upstream side of the stamper processing unit 200 in the sheet conveyance direction. That is, the distance $L_1$ is a distance which exceeds a distance from the inlet of the sheet feed drum 40 to the detection position of the inline sensor 58, and is less than a distance from the inlet of the sheet feed drum 40 to the stamp position of the stamper processing unit 200.

As shown in FIG. 5, the excitation period of the solenoid actuator 222 is defined as $t_1$. That is, if the solenoid actuator 222 is excited, the arm 216 is rotated so as to be erected, and the stamp roller 210 moves to the stamp position Y, the excitation of the solenoid actuator 222 is turned off according to the elapse of the excitation period $t_1$.

As described above, after the excitation of the solenoid actuator 222 is turned off, the erection state of the arm 216 is maintained by the latch mechanism (not shown).

If the arm 216 is brought into the erection state, a home position detection of the arm 216 is not detected (sensor off) by the optical sensor 226 (refer to FIG. 3). After a predetermined period $t_2$ elapses from a supply timing of excitation current to the solenoid actuator 222, if conditions of turning on of the solenoid actuator 222 and non-detection of the home position of the arm 216 are satisfied, it is transited to a stamp possible state.

The period $t_2$ from the identification timing of the stamp performance conditions to the stamp possible state is determined according to conditions of electric characteristics of the solenoid actuator 222, sensitivity of optical sensor 226, or the like. In the present example, the period $t_2$ is approximately ⅓ the excitation period of the solenoid actuator 222.

If the sheet P to be stamped reaches the stamp performance position and the stamping is performed, it is transited to a stamp impossible state. In addition, the first stamper unit 202 collides with the sheet P, and the arm 216 is returned to the standby position X (refer to FIG. 3).

Here, the "stamp performance position" is a position at which ink is attached to the sheet P in the conveyance route of the sheet P by the first stamper unit 202 or the second stamper unit 204 so as to perform the stamping.

If the erection state of the arm 216 is released and the stamp roller 210 moves from the stamp position Y to the standby position X, the home position detection of the arm 216 is detected (turned on) by the optical sensor 226.

<Fail Detection>

Figure 6:
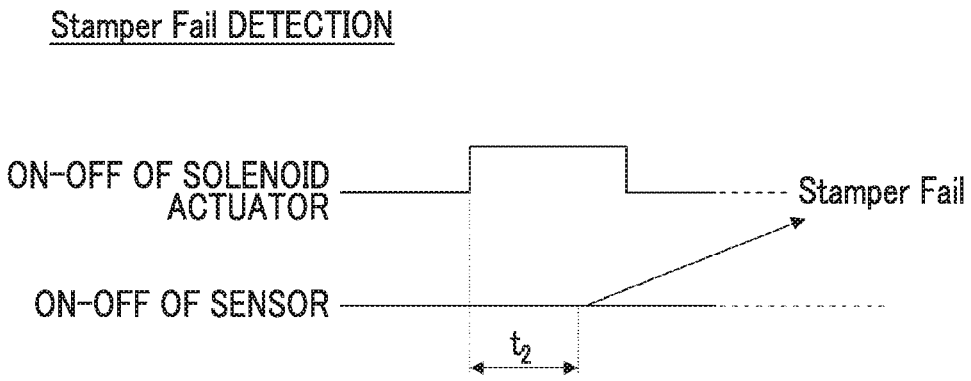
FIG. 6 is an explanatory view of a stamper failure.
Figure 7:
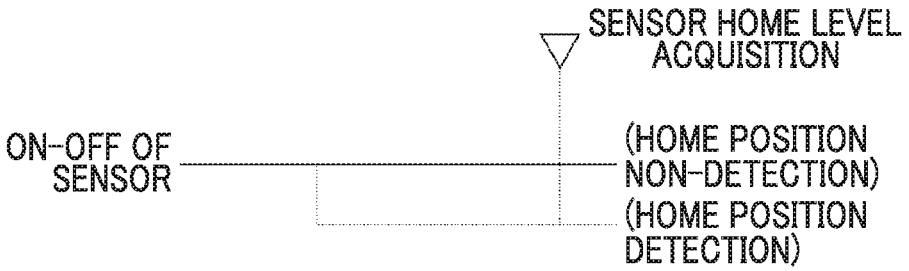
FIG. 7 is an explanatory view of another aspect of the stamper failure.

Next, fail detection will be described. FIGS. 6 and 7 are explanatory views of the fail detection in the first stamper unit 202 (second stamp stamper unit 204).

The first stamper unit 202 shown in the present example has a fail detection function. If the stamping is continuously performed a predetermined number of times or more, it is regarded as stamp limit fail. In addition, in a case where the first stamper unit 202 fails, when the stamper is not positioned (when the arm 216 is erected) at the home position in addition to the stamp performance, it is regarded as the stamper failure.

If the stamper limit fail occurs, the printing operation of the ink jet recording device is stopped, all sheets in the device are discharged, and the subsequent printing operation is inhibited. If all sheets P in the device are discharged, the conveyance of the sheet P is restarted, and stamping is performed on all sheets P after the sheet P causing the stamper limit fail.

If the stamp control unit 208 receives a release command, the stamper limit fail is released.

As shown in FIG. 6, occurrence conditions of the stamper failure include a case where the first stamper unit 202 is not operated after the period of $t_2$ elapses after the excitation current is supplied to the solenoid actuator 222 (FIG. 6), or a case where the first stamper unit 202 is not positioned at the home position during inputting of power, during change of printing, or after a purge due to jamming of sheet ends (FIG. 7).

When the stamper failure occurs during printing, the printing is stopped, all sheets P in the device are discharged, and the subsequent printing operation is inhibited. If all sheets in the device are discharged, the conveyance of the sheet P is restarted.

If causes of the fail are removed, device operation conditions are identified, and the home position of the first stamper unit 202 is indentified, the stamper failure is released.

<Maintenance Detection>

Next, maintenance detection will be described. The first stamper unit 202 shown in the present example has a function which notifies replacement of replacement components being near, or the components in the time of replacement. The display unit 132 of FIG. 4 is applied to this notification, and the notification is performed by character information or the like.

When the number of times of operations of the solenoid actuator 222 is measured and the measured value exceeds a first predetermined number of times, the time of the replacement being near is notified. In addition, when the number of times of operations of the solenoid actuator 222 exceeds a second predetermined number of times (>the first number of times), the components being in the time of replacement is notified.

When the time of the replacement is notified, the running printing job is not stopped and is continued. In addition, the print job is set so as to be performed after the replacement is notified. If a release command from the operating unit 130 of FIG. 4 is input, the maintenance detection is released.

<Operation and Control of Second Stamper Unit>

Figure 8:
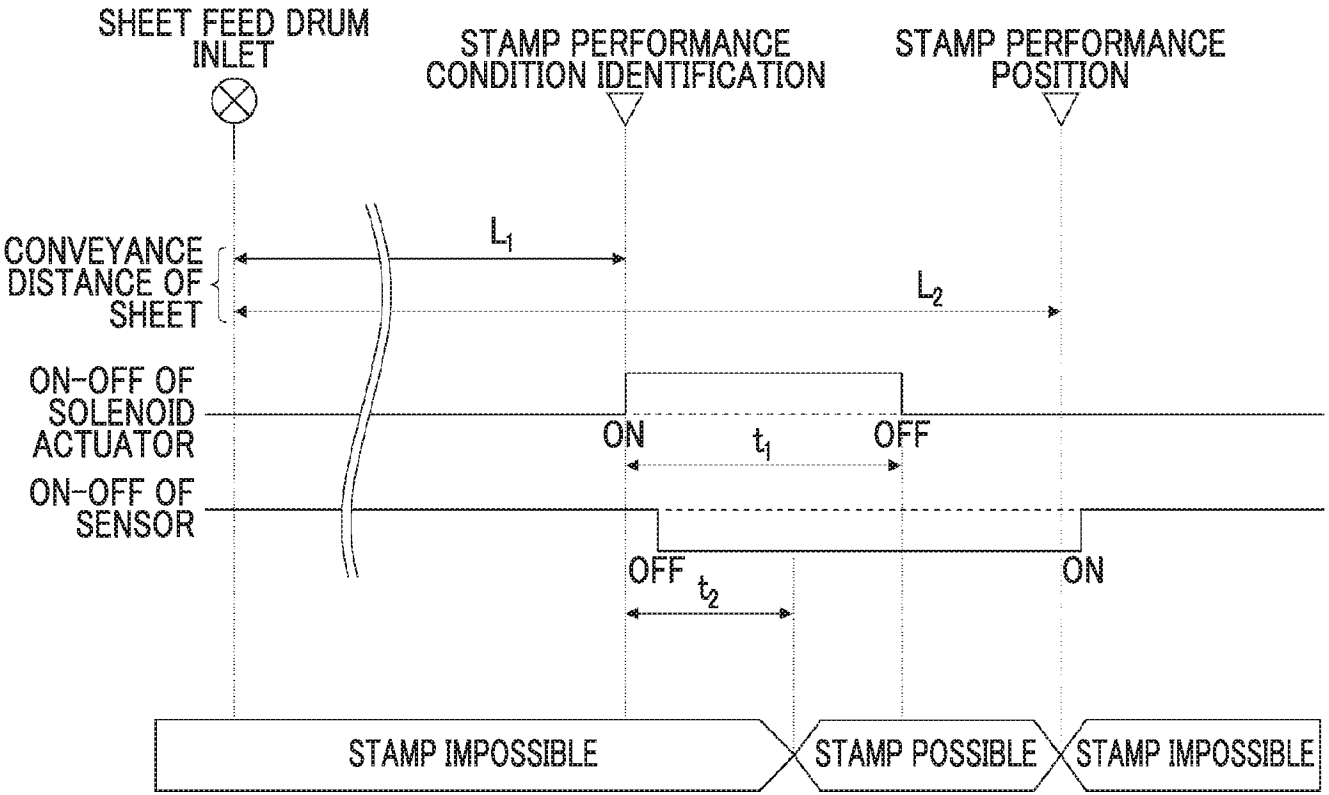
FIG. 8 is an explanatory view of a control timing of the second stamper unit.

Next, the operation and control of the second stamper unit 204 (classification stamper) will be described. FIG. 8 is a timing chart showing a control example of the second stamper unit 204 (refer to FIGS. 2 and 3).

As described above, the second stamper unit 204 attaches ink to the leading end edge $P_1$ of the sheet P corresponding to the predetermined sorting number of copies according to the command from the stamp control unit 208.

That is, the sorting number of copies is set in advance. The setting of the sorting number of copies is performed by the setting unit 138 of FIG. 4. The sorting number of copies may be input from the operating unit 130, or may be input via the communication unit 102. The set value of the sorting number of copies is sent from the setting unit 138 to the stamp control unit 208 via the system controller 100.

The number of the sheets which are fed from the sheet feed portion 12 of FIG. 1 is measured by the sheet counter 134 of FIG. 4. The measured value of the sheet counter 134 is supplied to the stamp control unit 208 sequentially (over a predetermined period of time) via the system controller 100.

If the measured value of the sheet counter 134 reaches the setting of the sorting number of copies, the stamp control unit 208 sends an operation command to the second stamper unit 204. That is, the stamp performance conditions of the second stamper unit 204 are satisfied when the measured value of the sheet counter 134 reaches the setting of the sorting number of copies.

In addition, the conveyance distances $L_1$ and $L_2$ of the sheet P, the excitation period $t_1$ of the solenoid actuator 222, the excitation timing, and the detection of the optical sensor 226 are similar to those of the above-described first stamper unit 202, and here, descriptions thereof are omitted. In addition, the fail detection and the maintenance detection are also similar to those of the above-described first stamper unit 202, and, here, descriptions thereof are omitted.

<Simultaneous Use Control of First and Second Stamper Unit>

Figure 9:
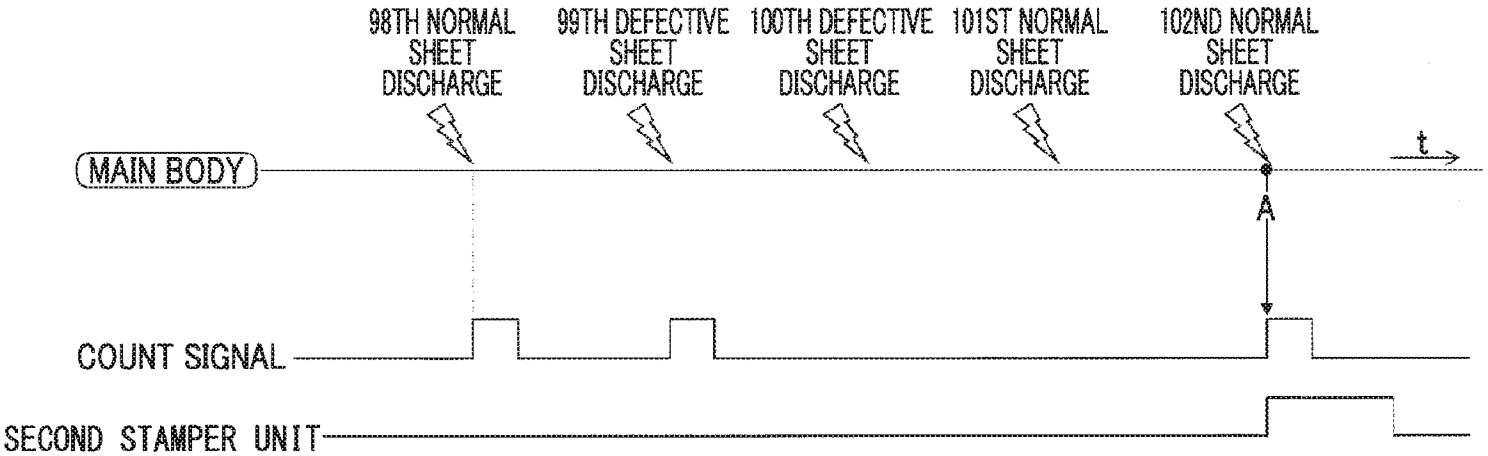
FIG. 9 is an explanatory view showing an example of a control method which simultaneously uses the first and second stamper units.

Next, an operation and control with respect to a simultaneous use of the first stamper unit 202 and the second stamper unit 204 will be described. FIG. 9 is an explanatory view of the control with respect to the simultaneous use of the first stamper unit 202 and second stamper unit 204.

The first stamper unit 202 and the second stamper unit 204 are simultaneously used. Accordingly, if the first stamper unit 202 and the second stamper unit 204 are independently controlled, there is a concern that the defective sheet P may be included in the sheet bundle in which the number of copies is assorted by the second stamper unit 204.

As shown in FIG. 9, when the first stamper unit 202 and the second stamper unit 204 are simultaneously used, a count function which counts the sheets P conveyed to the stamper processing unit 200 is provided.

In addition, the stamp control unit 208 recognizes a relationship between the sorting number of copies set by the setting unit 138 and the number of copies of the sheet P conveyed to the stamper processing unit 200 by the count function, and when the defective sheet P is included, a count signal is turned off.

As shown in FIG. 9, for example, when the sheets are assorted into the number of copies of 100 sheets, in a case where a defective 100th sheet and a defective 101st sheet continuously occur, the count signals with respect to the 100th sheet and the 101st sheet are turned off, and the number of copies is not counted.

In addition, the count signal with respect to a 102nd sheet which is a normal sheet which is discharged next is turned on, and the second stamper unit 204 is operated. Accordingly, even when the defective sheet P occurs during the management of assortment of the number of copies, it is possible to attach ink to the sheet P corresponding to the correct sorting number of copies.

Moreover, the number of the generated defective sheets P is stored, and the number of the normal sheets P may be recognized by subtracting the number of the generated defective sheets P from the number of the defective sheets P stored from the measured value of the sheet counter 134 (refer to FIG. 4).

<<Response to Duplex Printing>>

In the above-described ink jet recording device 10, the printing is performed on one side of the sheet P. It is also possible to perform printing on both sides of the sheet P using this configuration. For example, there is an aspect which includes a sheet reversal portion which reverses the surface and the rear surface of the sheet P discharged from the sheet discharging portion 24, a second conveyance portion which feeds the sheet P in which the surface and the rear surface are reversed to the sheet feed portion 12, and a sheet setting portion which sets the sheet P from the second conveyance portion to the sheet feed portion 12.

In addition, there is also an aspect in which the configurations from the sheet feed portion 12 to the UV irradiation processing portion 22 are provided between the UV irradiation processing portion 22 and the sheet discharging portion 24.

In consideration of the duplex printing, the first stamper unit 202 and the second stamper unit 204 shown in the present example are disposed such that the positions in the width direction of the sheet P are deviated from each other. For example, the first stamper unit 202 and the second stamper unit 204 are disposed at positions at which distances from the center position in the width direction of the sheet P are different from each other.

According to this configuration, at the time of a rear surface printing, even when stamping is performed on the sheet P, in which stamping is performed by the first stamper unit 202 at the time of a surface printing, by the second stamper unit 204, the stamps do not overlap each other at the same position.

<<Description of Effect>>

As described above, according to the ink jet recording device 10 of the present embodiment, if the defective sheet P is detected, the stamp control unit 208 drives and control the first stamper unit 202, and the first stamper unit 202 attaches ink to the leading end edge $P_1$ of the objective sheet P. Accordingly, it is possible to simply specify the defective sheet P visually among the sheets P loaded on the sheet discharging portion 24.

In the case where the sorting number of copies (for example, a unit of 100 sheets) is managed based on the preset sorting number of copies, when the sheet P (for example, 100th sheet) corresponding to the set value of the sorting number of copies is conveyed to the position of the second stamper unit 204, the stamp control unit 208 attaches ink to the leading end edge $P_1$ of the sheet P. The attachment of ink to the sheet P corresponding to the sorting number of copies is repeated. Accordingly, it is possible to simply specify a bundle for each sorting number of copies visually among the sheets P loaded on the sheet discharging portion 24.

In this case, the defective sheet P is not counted, and the classification stamp is not performed on the defective sheet P. Accordingly, it is possible to prevent a risk of a defective sheet P being included in the sorting number of copies.

Therefore, it is possible to incorporate automation with respect to the specification operation of a defective medium and the management of the sorting number of copies into the ink jet recording device 10, and compared to a tape inserter of the related art, the printing device includes following advantages due to characteristics of the first stamper unit 202 and the second stamper unit 204.

Since the first stamper unit 202 and the second stamper unit 204 simply attach ink to the leading end edge $P_1$ of the conveyed sheet P, a speed from starting of the operation to ending of the operation is high, and for example, the printing device can cope with a high speed ink jet recording device such as an ink jet recording device for business use.

Since the first stamper unit 202 and the second stamper unit 204 use the method which attaches ink to the sheet P, when the sheets P are loaded on the sheet discharging portion 24, the ink serving as a mark does not fall out.

Unlike the tape inserter of the related art, the first stamper unit 202 and the second stamper unit 204 are not limited to being disposed on the sheet discharging portion 24, and as long as the first stamper unit 202 and the second stamper unit 204 are disposed on the downstream side of the image recording portion 18 in the conveyance portion, the first stamper unit 202 and the second stamper unit 204 can be disposed at any position. Accordingly, it is possible to increase a degree of freedom of design with respect to dispositions of the members of the ink jet recording device 10.

Since the first stamper unit 202 and the second stamper unit 204 use the method which attaches ink to the sheet P, even when air flows around the stamper units, there is no problem. Like the configuration of the device shown in FIG. 1, even when the guide plate 72 of the back tension application mechanism 66 extends to immediately before the first stamper unit 202 and the second stamper unit 204 and suction air occurs due to the suction holes of the guide plate 72, it is possible to reliably perform the stamping.

Therefore, according to the first stamper unit 202 and second stamper unit 204, it is possible to solve a problem accompanied by high speed, a mark falling-out problem, a problem in a degree of freedom of disposition, and a problem in a disposition environment which occur when the tape inserter is used.

Since the color (kind) of the ink used in the first stamper unit 202 and the color (kind) of the second stamper unit 204 are different from each other, it is possible to easily distinguish whether the ink attached to the leading end edge of the recording medium is the ink for the specification operation of the defective medium or the ink for the management of the sorting number of copies.

In addition, in the present embodiment, since the opening/closing lid 225 of the stamp container 214 is opened and closed so as to be interlocked with the protruding and retracting movement of the stamp container 214 performed by the solenoid actuator 222, when the stamping is not performed and is in a standby state, it is possible to prevent the ink of the stamp roller 210 from drying.

In this case, when the ink (stamper ink) used in the first stamper unit 202 and the second stamper unit 204 is formed of a highly water retentive material, it is possible to further prevent the ink of the stamp roller 210 from drying.

Particularly, since defects rarely occur and the first stamper unit is rarely driven, when the highly water retentive material is contained in the ink, it is possible to prevent the ink of the stamp roller 210 from drying.

A composition example of the stamper ink is shown in [Table 1]. In addition, in [Table 1], "CAS No." is a Chemical Abstracts Service (CAS) registration number. In addition, "<2" means being less than 2 percent.

TABLE 1

| Component | Content (%) | CAS No. |
|---|---|---|
| Diethyleneglycol | 2-7 | 111-46-6 |
| Ethyleneglycol | 22-27 | 107-21-1 |
| Diethyleneglycol monomethyl ether | 2-7 | 111-77-3 |
| Water | 32-37 | 7732-18-5 |
| Glycerine | 22-27 | 56-81-5 |
| C. I. Acid Red 73 | 1-5 | 5413-75-2 |
| C. I. Acid Red 14 | <2 | 3567-69-9 |

In the first stamper unit 202 and the second stamper unit 204 in the present embodiment, the leading end edge $P_1$ of the sheet P which is conveyed by the conveyance portion abuts the stamp roller 210, and ink is attached to the leading end edge $P_1$. Accordingly, even when the speed of the ink jet recording device increases, that is, even when the conveyance of the sheet P performed by the conveyance portion is rapid, it is possible to reliably attach the ink to the leading end edge of the sheet P.

The stamp roller 210 is retracted by the force by which the leading end edge of the sheet P abuts the stamp roller 210. Accordingly, since the stamp roller 210 is exposed to only the sheet P to which the ink is attached, there is no interference with the conveyance of the sheet P in which the ink attachment is not required.

Since the opening/closing lid 225 of the stamp container 214 which accommodates the stamp roller 210 is closed so as to be interlocked with the retracting movement of the stamp roller 210, it is possible to further prevent the ink from drying.

The chain gripper 64 is provided at least in the vicinity of the sheet discharging portion 24 of the conveyance portion, and the first stamper unit 202 and the second stamper unit 204 are provided inside the chain gripper 64. Accordingly, even when the first stamper unit 202 and the second stamper unit 204 are mounted on the ink jet recording device 10, the size of the ink jet recording device 10 does not increase.

In the present example, a unit type (double stamper unit) is exemplified in which the first stamper unit 202 and the second stamper unit 204 are accommodated in the casings 206A and 206B, and the means for controlling the operation of the first stamper unit 202 and the means for operating the second stamper unit 204 are commonly used. However, the means for controlling the operation of the first stamper unit 202 and the means for operating the second stamper unit 204 may be separately provided. In addition, a portion of the means for controlling the operation of the first stamper unit 202 and the means for operating the second stamper unit 204 may be commonly used.

In the present example, the aspect is exemplified in which the arm 216 is rotated by the protruding and retracting movements of the first stamper unit 202 and the second stamper unit 204. However, an aspect which moves the stamp container 214 up and down may also be adopted.

In the present example, the ink jet recording device 10 in which the coated paper is applied as the sheet P is exemplified. However, in the present invention, a sheet-shaped member or substrate except for paper such as a resin sheet (substrate), a metal sheet (substrate), or a glass substrate may be used as the sheet P.

In addition, the application range of the present invention is not limited to the image-forming device (printing device) for a graphic purpose. For example, the present invention can be widely used in an industrial image-forming device such as a pattern forming device which forms a wiring pattern or a mask pattern on a substrate.

EXPLANATION OF REFERENCES

10 . . . ink jet recording device, 12 . . . sheet feed portion, 18 . . . image recording portion, 24 . . . sheet discharging portion, 52 . . . image recording drum, 52A and 64D . . . gripper, 56, 56M, 56Y, 56K . . . ink-jet head, 58 . . . inline sensor, 64 . . . chain gripper, 100 . . . system controller, 110 . . . conveyance control unit, 112 . . . sheet feed control unit, 124 . . . sheet discharging control unit, 130 . . . operating unit, 132 . . . display unit, 134 . . . sheet counter, 136 . . . image defect detection unit, 138 . . . setting unit, 200 . . . stamper processing unit, 202 . . . first stamper unit, 204 . . . second stamper unit, 208 . . . stamp control unit, 210 . . . stamp roller (stamp portion), 212 . . . retractable mechanism, 214 . . . stamp container, 216 . . . arm, 218 . . . rotary shaft, 222 . . . solenoid actuator, 226 . . . optical sensor, P . . . sheet

What is claimed is:

1. A printing device, comprising:

a sheet feed portion which feeds a recording medium sheet;

a sheet discharging portion on which recording medium sheets having images recorded are to be loaded;

a conveyance portion which conveys the recording medium sheet from the sheet feed portion to the sheet discharging portion;

an image recording portion which records an image on a surface of the conveyed recording medium sheet by the conveyance portion;

an image defect detection unit which detects a recording medium sheet, on which image defects occur, among the recording medium sheets having the images recorded by the image recording portion;

a first stamper unit which is provided on a downstream side of the image recording portion in the conveyance portion with respect to a conveyance direction of the recording medium sheet and attaches ink to a leading end edge of the recording medium sheet on which the image defects occur;

a first stamp control unit which controls an operation of the first stamper unit based on detection results of the image defect detection unit;

a receiving unit which receives an input of a number of sheets which is a unit of sorting when the recording medium sheets loaded on the sheet discharging portion are sorted by a definite number;

a setting unit which sets the received number as a sorting number of sheets;

a second stamper unit which is provided on the downstream side of the image recording portion in the conveyance portion with respect to the conveyance direction of the recording medium sheet and attaches ink to the leading end edge of the recording medium corresponding to the sorting number of sheets set by the setting unit; and a counting unit which counts a number of recording medium sheets conveyed to the second stamper unit;

a second stamp control unit which controls an operation of the second stamper unit based on the number of the recording medium sheets conveyed to the second stamper unit and the sorting number of sheets set by the setting unit.

2. The printing device according to claim 1, wherein stamp performance positions, at which stamping which attaches ink to the recording medium sheet using the first stamper unit and the second stamper unit is performed, are same as each other in the conveyance direction of the conveyance portion, and wherein distances of the first stamper unit and the second stamper unit from positions corresponding to a center position of the recording medium sheet in a direction orthogonal to the conveyance direction of the conveyance portion are different from each other.

3. The printing device according to claim 1, wherein a kind of the ink used in the first stamper unit and a kind of the ink used in the second stamper unit are different from each other.

4. The printing device according to claim 1, wherein the ink which is used in the first stamper unit and the second stamper unit is formed of a highly water retentive material.

5. The printing device according to claim 1, wherein each of the first stamper unit and the second stamper unit includes: a stamp portion into which ink is impregnated, and a retractable mechanism which causes the stamp portion to protrude toward a stamp position of the recording medium sheet and retracts the stamp portion from the stamp position, and wherein in a state where the stamp portion protrudes toward the stamp position, the lead end edge of the recording medium conveyed by the conveyance portion abuts the stamp portion and ink is attached to the leading end edge, and the stamp portion is retracted from the stamp position by a force of the abutment.

6. The printing device according to claim 5, wherein the stamp portion is accommodated in a stamp container, and an opening/closing lid, which opens and closes the stamp container so as to be interlocked with the retractable mechanism and exposes and seals the stamp portion, is provided in the stamp container.

7. The printing device according to claim 5, wherein the first stamper unit includes: a stamp movement portion which moves the stamp portion between a standby position and the stamp position, and a position detection unit which detects whether the stamp portion is positioned at the standby position or the stamp position, and wherein the conveyance portion stops conveyance of the recording medium sheet when it is not detected that the stamp portion is positioned at the stamp position by the position detection unit after a predetermined period elapses from a timing when the stamp movement portion starts a movement which moves the stamp portion from the standby position to the stamp position.

8. The printing device according to claim 7, wherein the conveyance portion stops the conveyance of the recording medium sheet when it is not detected that the stamp portion is positioned at the standby position by the position detection unit in at least one of at the time of device operation start and at the time of print job change.

9. The printing device according to claim 1, wherein the conveyance portion includes a chain gripper, in which a plurality of grippers holding a leading end portion of the recording medium sheet between a pair of chains are provided at a position on the downstream side of the image recording portion in the conveyance direction of the conveyance portion, and on an upstream side of the sheet discharging portion, which discharges the recording medium sheet having images formed by the image recording portion, in the conveyance direction of the conveyance portion, and wherein the first stamper unit and the second stamper unit are provided inside the disposition position of the chain gripper.

10. The printing device according to claim 9, wherein the chain gripper is disposed along an inclined surface which has an upward inclination with respect to a horizontal surface, and wherein the first stamper unit and the second stamper unit are disposed in a depressed portion which is formed on the inclined surface.

11. The printing device according to claim 1, wherein the first stamper unit and the second stamper unit have a same configuration as each other.

12. The printing device according to claim 1, wherein the second stamp control unit operates the second stamper unit when the number of recording medium sheets except for the detected recording medium sheets having image defects reaches the set sorting number of sheets.

13. The printing device according to claim 1, wherein stamp performance positions, at which stamping which attaches ink to the recording medium sheet using the first stamper unit and the second stamper unit is performed, are same as each other in the conveyance direction of the conveyance portion.

* * * * *